US007669653B2

(12) United States Patent
Craster et al.

(10) Patent No.: US 7,669,653 B2
(45) Date of Patent: Mar. 2, 2010

(54) SYSTEM AND METHOD FOR MAINTAINING ZONAL ISOLATION IN A WELLBORE

(75) Inventors: Bernadette Craster, Waterbeach (GB); Roger Card, Houston, TX (US); Ashley Johnson, Milton (GB); Paul Way, Hauxton (GB); Hemant Ladva, Cambridge (GB); Jonathan Phipps, Lower Cambourne (GB); Geoffrey Maitland, Whittlesford (GB); Paul Reid, St. Neots (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 660 days.

(21) Appl. No.: 10/542,654

(22) PCT Filed: Feb. 20, 2004

(86) PCT No.: PCT/GB2004/000575

§ 371 (c)(1),
(2), (4) Date: May 5, 2006

(87) PCT Pub. No.: WO2004/074621

PCT Pub. Date: Sep. 2, 2004

(65) Prior Publication Data

US 2008/0023205 A1 Jan. 31, 2008

(30) Foreign Application Priority Data

Feb. 20, 2003 (GB) ..... 0303881.7

(51) Int. Cl.
*E21B 33/14* (2006.01)

(52) U.S. Cl. ..... 166/187; 166/387; 166/179; 166/101; 166/120

(58) Field of Classification Search ..... 166/101, 166/118, 120, 387, 179, 187
See application file for complete search history.

(56) References Cited

U.S. PATENT DOCUMENTS

| | | | | |
|---|---|---|---|---|
| 1,336,738 | A | | 4/1920 | Fletcher |
| 2,231,282 | A | | 2/1941 | Norris |
| 3,272,517 | A | | 9/1966 | Howard et al. |
| 3,750,750 | A | | 8/1973 | Urbanosky |
| 4,137,970 | A | | 2/1979 | Laflin et al. |
| 4,339,000 | A | * | 7/1982 | Cronmiller ..... 166/295 |
| 4,913,232 | A | * | 4/1990 | Cheymol et al. ..... 166/285 |
| 5,190,109 | A | | 3/1993 | Pardo |
| 5,358,054 | A | | 10/1994 | Bert |
| 5,361,836 | A | | 11/1994 | Sorem et al. |
| 5,667,010 | A | | 9/1997 | Boyd et al. |

(Continued)

FOREIGN PATENT DOCUMENTS

GB 2 370 301 A 6/2002

(Continued)

*Primary Examiner*—Jennifer H Gay
*Assistant Examiner*—Brad Harcourt
(74) *Attorney, Agent, or Firm*—James McAleenan; Jody Lynn DeStefanis; Dale Gaudier

(57) ABSTRACT

The invention concerns a system or a method for maintaining zonal isolation in a wellbore. According to the invention, the system comprises, at a specific location along said wellbore, a sealing element, said sealing element being able to deform both during and after placement and is maintained after placement under compression through a pressurizing fluid or by confinement in a volume.

50 Claims, 15 Drawing Sheets

U.S. PATENT DOCUMENTS

| | | | | |
|---|---|---|---|---|
| 5,992,522 | A | 11/1999 | Boyd et al. | |
| 6,041,858 | A | 3/2000 | Arizmendi | |
| 6,050,336 | A * | 4/2000 | Willauer et al. | 166/286 |
| 6,059,033 | A | 5/2000 | Ross et al. | |
| 6,187,839 | B1 * | 2/2001 | Eoff et al. | 523/130 |
| 6,196,316 | B1 | 3/2001 | Bosma et al. | |
| 6,244,344 | B1 | 6/2001 | Chatterji et al. | |
| 6,286,603 | B1 | 9/2001 | Parent | |
| 6,296,054 | B1 | 10/2001 | Kunz et al. | |
| 6,330,917 | B2 | 12/2001 | Chatterji et al. | |
| 6,350,309 | B2 | 2/2002 | Chatterji et al. | |
| 6,854,522 | B2 * | 2/2005 | Brezinski et al. | 166/387 |
| 2003/0178204 | A1 | 9/2003 | Echols et al. | |
| 2003/0196820 | A1 | 10/2003 | Patel | |
| 2005/0199401 | A1 * | 9/2005 | Patel et al. | 166/387 |

FOREIGN PATENT DOCUMENTS

| | | | |
|---|---|---|---|
| GB | 2 381 811 | A | 5/2003 |
| WO | 01/98627 | A1 | 12/2001 |
| WO | 02/28560 | A2 | 4/2002 |
| WO | 02/28560 | A3 | 4/2002 |

* cited by examiner

SYSTEM AND METHOD FOR MAINTAINING ZONAL ISOLATION IN A WELLBORE

The present invention generally relates to systems and methods for maintaining zonal isolation in a wellbore. More specifically, the invention pertains to such systems and methods capable of providing a seal being part of the permanent wellbore installation.

BACKGROUND OF THE INVENTION

In general, oil, gas, water, geothermal or analogous wells, which are more than a few hundreds of meters deep, contain a steel lining called the casing. The annular space between the underground formation and the casing is cemented over all or a large portion of its depth. The essential function of the cement sheath is to prevent fluid migration along the annulus and between the different formation layers through which the borehole passes and to control the ingress of fluid into the well.

However, this zonal isolation may be lost for a number of reasons. Mud may remain at the interface between the cement and the casing and/or the formation. This forms a path of least resistance for gas or other fluids movement. Changes in downhole conditions may induce stresses that compromise the integrity of the cement sheath. Tectonic stresses and large increases in wellbore pressure or temperature may crack the sheath and may even reduce it to rubble. Radial displacement of casing, caused by cement bulk shrinkage or temperature decreases, as well as decreases in fluid weight during drilling and completion, may cause the cement to debond from the casing and create a microannulus. Routine well-completion operations, including perforating and hydraulic fracturing, negatively impact the cement sheath.

Various methods are used to attempt to prevent a film of mud forming on the casing/formation surface. The most common methods involve use of spacers and wash fluids to remove as much as possible of the remaining mud and the mud filter cake from the walls of the wellbore. This process has been the subject of continuous modification and improvement over the past several decades, but success has been limited by the operational conditions and the limited amount of time and resources that can be put into these operations. As a result, the efficiency of mud removal is often less than desired.

On the other side, mechanical properties of cement, such as elasticity, expandability, compressive strength, durability and impact resistance have been improved, in particular, by the addition of fibres and/or plastic or metallic particles. Increased flexibility helps the cement respond to thermal, mechanical or pressure shocks and can minimize debonding of the cement from the metal casing or from the formation wall. Fibres are best at handling mechanical shocks, such as those encountered when one needs to drill through an existing cement sheath in order to form a lateral arm of the well. This is an important part of the construction of multilateral wellbores. Expandability ensures that the cement is held in compression behind casing thus allowing for pressure drops in the annulus without debonding between the casing and the isolating material. In this case, the expansion needs to be tailored to the mechanical properties of the formation and to the cement in order to be effective. These properties are not always known in sufficient detail to achieve optimal performance.

Also, various methods have been proposed to improve the sealing of the formations, including the use of cement with additives such as silicone as described in the U.S. Pat. No. 6,196,316 or epoxy resin (e.g. U.S. Pat. No. 6,350,309). In U.S. Pat. No. 5,992,522 the hydrostatic pressure of a column of bitumen is used to prevent vertical migration of fluids in a wellbore.

Other completion techniques are so-called "open hole" completions as often encountered in laterally extended wells. In open hole completion, the casing or production tubing is not cemented and zonal isolation when required is achieved by using packers. Packers are constituted by annular sealing rings comprising a double elastomer wall reinforced with a metal braid. The double wall delimits a chamber, which is usually inflated by cement or other suitable compositions such as expanding resin (as described in U.S. Pat. No. 5,190,109). Packers suffer from limitations and drawbacks, which are outlined, for example, in the U.S. Pat. No. 4,913,232 and are often not suitable for permanent wellbore installations.

Thus, there is a need for methods and systems that can be placed at key positions to provide zonal isolation or plugging in the wellbore. Further, there is a need for a single approach that can be used in a majority of completions. There is a need for a process that can be executed efficiently and reliably in the oilfield. There is further a need for a solution that, while generically useful, can readily be tailored to survive different down-hole environments such as maximum temperature and fluid exposure for an extended period of time, and ideally over the lifetime of the well. These fluids could be brines, hydrocarbons, carbon dioxide, hydrogen sulphide and may further include aggressive treatment fluids such as hydrochloric acid.

SUMMARY OF THE INVENTION

Considering the above, it is one aspect of the invention to provide an improved system and method for maintaining zonal isolation in a wellbore.

According to a first aspect of the invention, a system for maintaining zonal isolation in a wellbore, characterized in that said system comprises, at a specific location along said wellbore, a sealing element, said sealing element being able to deform both during and after placement.

In a second aspect, the invention concerns a method of maintaining zonal isolation in a wellbore, characterized in that it comprises the following steps: placing a sealing element at a specific location along said wellbore; allowing said sealing element to be able to deform both during and after placement and maintaining the sealing element in compression.

Important properties for ensuring a good seal according to this invention are that the material remains in compression after setting, and that its Young's modulus is sufficiently lower than that of the rock or cement such that the latter can effectively confine it, so that any radial stress developed in the sealing element is insufficient to cause significant movement of the surrounding rock. Therefore, the sealing material modulus is preferably an order of magnitude lower than the rock at 1-100 MPa. In principle there is no lower limit to the modulus, but materials below 1 MPa are more likely to be able to undergo viscoelastic flow and thus be able to relax their compressive stress by extrusion into cracks in the surrounding rock or cement or gaps at the interfaces between rock or casing and cement.

Thus, the sealing element is able to accommodate any likely conformational, pressure or temperature changes of the surrounding wellbore portion by contracting or expanding in response to said changes. As a result, if, after placement, a pathway constituted, in particular, by cement fractures or micro-annuli formed either, at the cement/casing interface or at the cement/formation interface, is created, then, said sealing element deforms and blocks said pathway hence preventing any fluid migration along the wellbore.

The state of compression can be maintained by using a connection element that provides a connection from the sealing element to a pressure reservoir, most preferably located at the surface.

Alternatively the sealing element is placed and sets in a state of compression in a volume limited by materials of high Young's modulus. This volume is in most application formed by the steel casing or tubing in the wellbore, the rock face and cement layers above and below the sealing element. The respective Young moduli of those boundary materials are all above 1000 MPa, hence, an order of magnitude higher than the sealing material, itself.

The sealing element is preferably a chemical compound that homogeneously fills the volume defined above.

A broad variety of chemical compositions and placement methods can be applied to achieve a zonal isolation in accordance with the invention.

These and other aspects of the invention will be apparent from the following detailed description of non-limitative modes for carrying out the invention and drawings.

MODES FOR CARRYING OUT THE INVENTION

Figure 1:
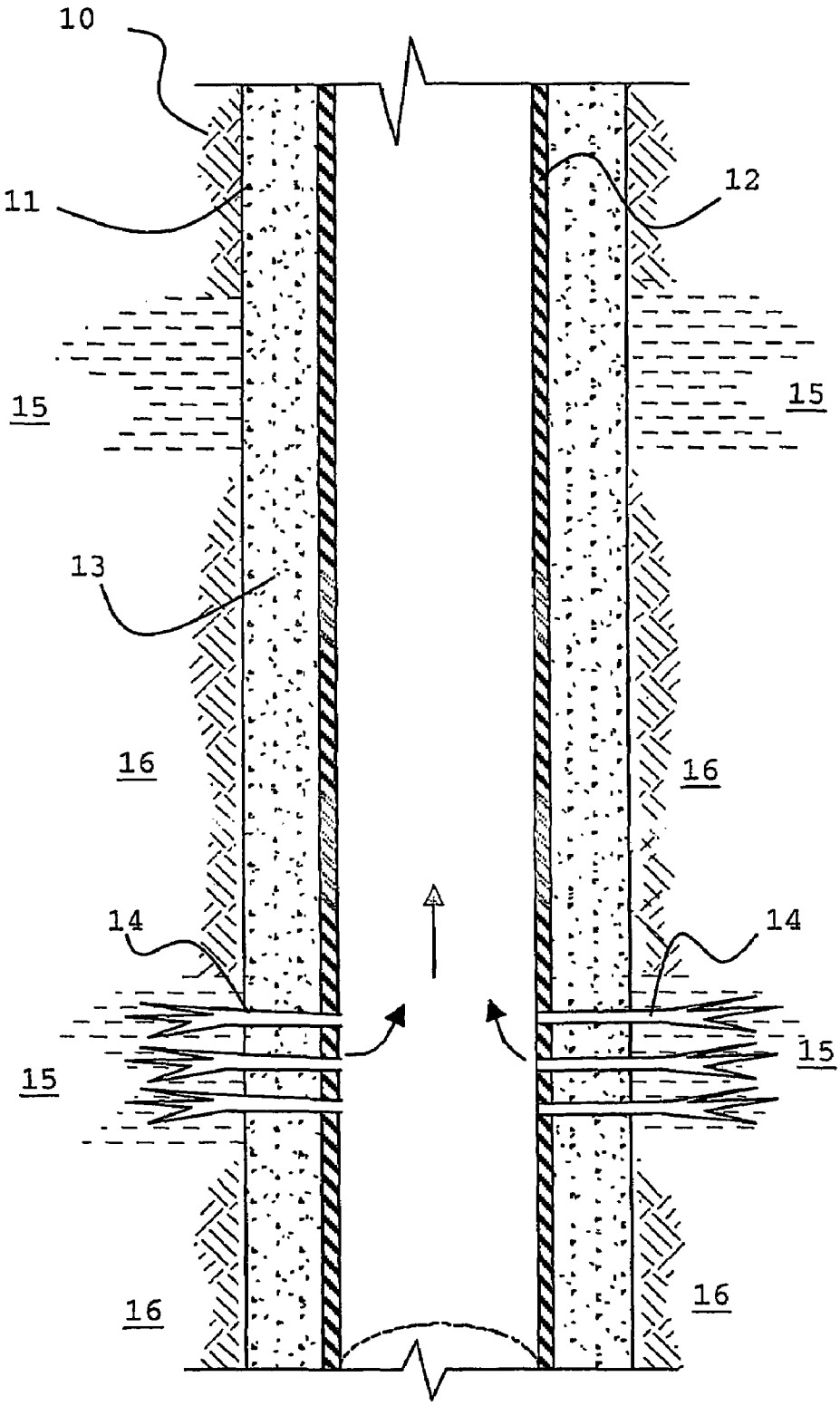
FIG. 1 (prior art)
FIG. 1 shows an example of a known zonal isolation system for cased boreholes.

According to the invention, the sealing material, which forms the sealing element, may be in a solid state or in a liquid state. If the sealing material is in a liquid state, it may be a yield stress fluid.

Sealing materials in a solid state will approximate the behaviour of an elastic solid. There are four parameters that may be used to describe the deformability of an elastic solid: the Young's modulus (E), the shear modulus (G), the bulk modulus (K) and the Poisson's ratio (v). These parameters are inter-related and satisfy to the following equations: $K=E/3(1-2v)$ and $G=E/2(1+v)$. The Young's modulus of the sealing material according to the invention, as well as the shear modulus of said material are, respectively, lower than the Young's modulus of typical cements that are used for downhole applications and than the shear modulus of said typical cements. In other words, the sealing material is more deformable than these typical cements. Advantageously, it is even more deformable than the most deformable cement produced by Schlumberger™ under the trademarked name FlexSTONE. In particular, the sealing material of the invention has preferably a Young's modulus below 1000 MPa, more preferably between 1 and 100 Mpa, whereas typical cements have a Young's modulus comprised between 5000 and 8000 MPa and FlexSTONE has a Young's modulus around 1000 MPa.

If the sealing material is in a liquid state, its Young's modulus and its shear modulus tend to become 0. Then, the sealing material of the invention tends to be infinitely deformable. If the sealing material is a yield stress fluid, then it is a gel or soft solid, which behaves like a solid below the yield stress and behaves like a liquid above said yield stress. This yield stress fluid may be visco-plastic or visco-elastic. Preferably, its yield stress value is high, greater than 10 Pa and, advantageously, greater than 600 Pa.

Where the sealing material is a yield stress fluid, the sealing material is advantageously a composite, which comprises a fluid continuous phase and solid particulate material or fibres. In a particular mode for carrying out the invention, the cement sheath and the sealing element form an intermingled, random composite material, wherein the sealing element/material forms a continuous path between the formation and the casing or across the casing or right across the wellbore diameter in the case of plug and abandonment or completes a continuous path within a discontinuous cement sheath, at a specific location along the wellbore.

When the sealing element is made of a solid material, then this solid material, which is elastic, is maintained, or held permanently, under compression. Practically, the sealing element may be pre-compressed, held under compression hydraulically (e.g. using an inflation tube) or held under compression using mechanical means. For example, the sealing element may be held in compression by external means such as surrounding cement portions.

The requirement that the sealing element be kept in a state of compression is principally to prevent the formation of a microannulus between the sealing element and the casing. However, it is also beneficial in preventing any radial cracking of the material which might result from expansion of the well placing the material in a state of tangential tension, because the compressive stress first has to be reversed before tension can occur. A low modulus greatly reduces the likelihood of tension occurring, because it increases the strain required to achieve it. Because the steel casing is by far the strongest component in the wellbore, increases in wellbore pressure are not transmitted directly to the annular sealant as corresponding stresses, but rather as small strains resulting from the expansion of the casing. With a low modulus material, the stress resulting from such a strain is correspondingly lower than with a high modulus material. Furthermore, if the material has a high Poisson's ratio then the stress will be more uniformly distributed across the annulus. This is in contrast to the typical case for a cement, for which the low Poisson's ratio means that the cement may be simultaneously in tangential tension at the casing interface and in tangential compression at the wellbore wall even if the rock is strong enough to confine it effectively.

According to a further example, a compressed ring in a groove on a casing may be kept in place by a plastic or metal sleeve, which melts or dissolves or slides once the casing is in place to release the sealing ring and to press against formation, still under compression. Also, a rubber cylinder may be placed on the outside of the casing, across the casing junction, with steel rim at both ends. When the casing is in place, the casing sections are twisted together on their thread, or pushed further together, to buckle the rubber cylinder out into a compressed seal that fills the annulus. Similarly, the rubber cylinder may cover a bellows section of casing, kept open by struts, which are removable once casing is in right position. The weight of the upper casing then compresses the bellows and the rubber cylinder buckles out to form the seal.

If the sealing element is to be placed in fluid form, the sealing material is required to be sufficiently fluid prior to setting to be pumped, injected or placed at a specific downhole location. It may be a liquid or a gel placed in the annulus or on the outside of the casing, which is subsequently activated to transform to a visco-elastic solid or visco-plastic liquid seal by expansion of parts of the casing crushing encapsulated setting component of said sealing material, by an external trigger, for example, thermal or ultrasonic, said external trigger being placed at the required position in the annulus or the casing, or by injection of an activator into the annulus or through the casing.

If the sealing element does not set to form a solid material, that is to say, when said sealing element comprises either a liquid or a yield stress fluid, then it is not necessarily maintained under compression by such external means. Compression may result from the hydrostatic pressure of the liquid/yield fluid column that forms the sealing material. The sealing element would be however supported by external means, for example, by a cement portion of the cement sheath. In some particular modes for carrying out the invention, the sealing element is kept in compression through a supply line. This supply line may also be used to monitor the pressure in the sealing element from a surface site.

Another option according to the invention relates to the conversion of mud and/or filter cake in place after drilling into a sealing element elastic solid or suitable visco-plastic liquid/solid by an expandable element of the well tube activating the release of additional setting components. The conversion can be achieved by, for example, injecting, at the required position into the annulus or through a valve in the casing, additional setting components, or by using external triggers for the release or the activation of setting components applied at the required position by direct insertion into the annulus or within/through the casing.

Advantageously, the sealing material does not suffer from shrinkage upon setting, which is a condition for isotropic compressive stress, and it is able to maintain its hydrostatic load after setting. It is impermeable to the fluids that may migrate along the wellbore. Also, it is durable and its density may be adjusted.

In a conventional placement procedure, a material such as cement is pumped into the wellbore in a fluid state. It is then allowed sufficient time to cure to a solid state which is not able to deform. Placement, according the invention, has to be understood in a large sense as comprising all the steps from the initial pumping to the point where the final material properties of the sealing material have been attained.

According to the invention, the sealing element is deformable for an extended period of time after placement, throughout the production phase of the well or after said production phase. Ideally, when said sealing element is placed during the life of the well, its deformability properties should last for said life and survive appropriate maintenance or remedial operations. This includes surviving pressure and temperature shocks associated with routine well operations such as perforating, well testing, hydraulic fracturing or acid fracturing. This also includes, for example, shocks due to shutting in and re-initialising hydrocarbon production. Practically, the sealing element is designed to remain deformable for at least 5 years after placement in the wellbore. Preferably, it is designed to remain deformable for at least 30 years. When the sealing element is placed as a plug for well abandonment then the above 5- and 30-year durations apply.

According to the invention, the sealing element is placed at a specific location along the wellbore. When the formation comprises at least a first layer and a second layer, said first layer being essentially impermeable and said second layer being permeable, then the sealing element is placed, at least partially, adjacent to the first layer. Generally, this first layer is located above the second layer and forms a caprock for the permeable layer. Practically, said caprocks are formed by shale, limestone, granite or other impermeable rocks. In fact, a function of the sealing element is to restore the zonal isolation of fluids in the formation to the same condition as before the reservoir's natural seals were broken by the drilling of the well.

The sealing element presents restrictive dimensions as compared to the dimensions of the wellbore. Practically, each sealing element presents an average height, measured along the wellbore axis, is less than approximately 150 m and, preferably, less than approximately 60 m. More preferably, its average height is comprised between approximately 1 m and approximately 30 m. However, to counter the effects of fluid mixing, e.g. at the interface between cement and sealant, it may be advantageous to maintain a minimum length or height of 30 to 60 meters.

According to the invention, the sealing element may be placed at a specific location in the wellbore during the well construction phase or later, during the well production phase or along with the final plug and abandon process.

For example, the sealing element may be placed during drilling, in the case of a casing drilling. In another example, the sealing element is placed on the casing before said casing is lowered into the borehole. In such case, the sealing element may be pre-coated or pre-placed on the outer surface of the casing. In some cases, the sealing material may reinforce an inflatable mechanical seal. Then, it is placed either between the mechanical seal and the formation or casing, or above and below said mechanical seal. In case of plugging or abandonment operations, the sealing element may have an essentially full cylindrical or disk shape to seal the full cross-section of the well.

When the sealing element is placed in the annulus formed by outside wall of casing or production pipes within the borehole and its wall, it forms a ring. Elasticity and compression ensure that inner face of the ring maintains an intimate fluid-tight contact with the wall of the borehole pipes while the outside of the ring seals the wall of the borehole.

The sealing element may also be entirely contained in the casing or, where under-reaming is carried out, across both the casing and the annulus. In fact, where a shale seal has softened in drilling, an under-reaming is carried out and the sealing material is placed in the under-reamed section of the well.

Advantageously, the sealing elements are placed using methods known in principle from the placement of external casing packers (ECP) or coiled tubing. Alternatively, the elements may be placed as fluids using a pumping step from the surface or by making use of well intervention or remedial operations.

There are various possible implementations of the system and method of the invention, which are described in the following, by comparison with the prior art.

In FIG. 1, a part of a known cased hole completion is shown in which a borehole 11 penetrates the earth 10. The borehole 10 passes through various layers of the formation, including permeable layers 15 surrounded by impermeable layers 16. After drilling, a steel casing 12 is pushed from the surface into the borehole 10. With the casing in place, cement 13 is pumped from the surface through the inner of the casing to rise back to the surface in the annulus between the casing and the wall of the formation. Once the cement is set, the casing is held in place and fluids communication between layers 101, 102 is generally blocked. To re-open fluid paths up to the oil-bearing permeable layers 15, perforations 14 are shot into the casing. Oil can flow out of the formation through these perforations 14 and is pumped to the surface as indicated by the solid arrows.

Figure 2A:
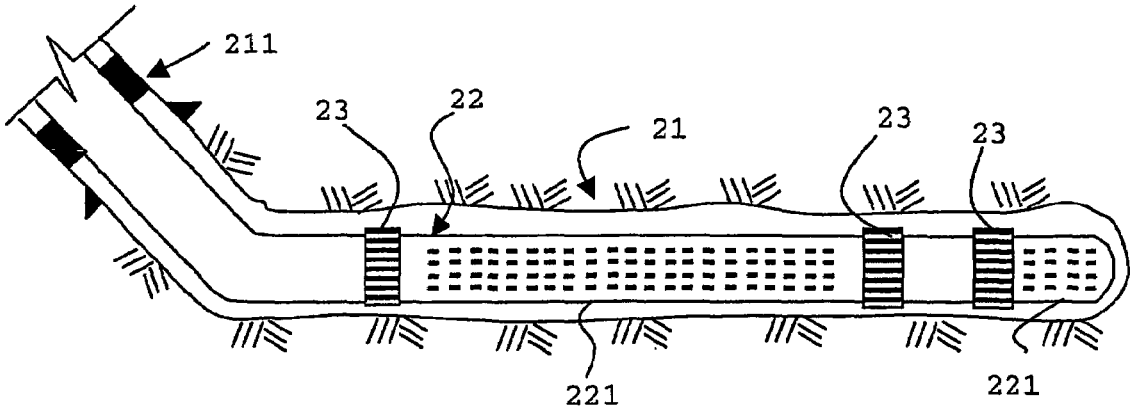
FIG. 2A(prior art)
FIGS. 2A and 2B show examples of a known zonal isolation system for open hole completions.
Figure 2B:
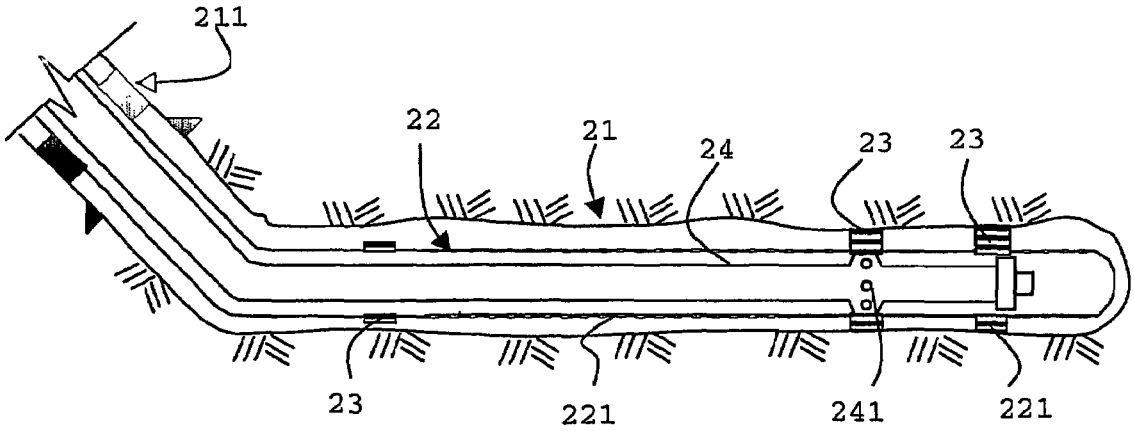
FIG. 2B(prior art)

In an open hole completion, as illustrated in FIGS. 2A, B, multiple external casing packers ("ECP") are used to isolate well sections. A lateral well bore 21 is shown with a liner hanger section 211. A (slotted) liner 22 is suspended from the liner hanger and extends into the open hole 21. Each slotted section 221 of the liner is framed by ECPs 23. In FIG. 2A, the packers 23 are shown deflated for the placement of the liner 22. An inflation tool 24 runs from the surface with several injection ports 241. When the injection ports are located across an ECP valving system (not shown), the packers are inflated with cement. In FIG. 2B, two of the three packers 23 are shown in an inflated state. After completing the inflation operation, the inflation tool is pulled from the well. The inflated packers 23 ensure that the zones equipped with slotted liner sections 221 are isolated from other sections of the well bore.

Figure 3A:
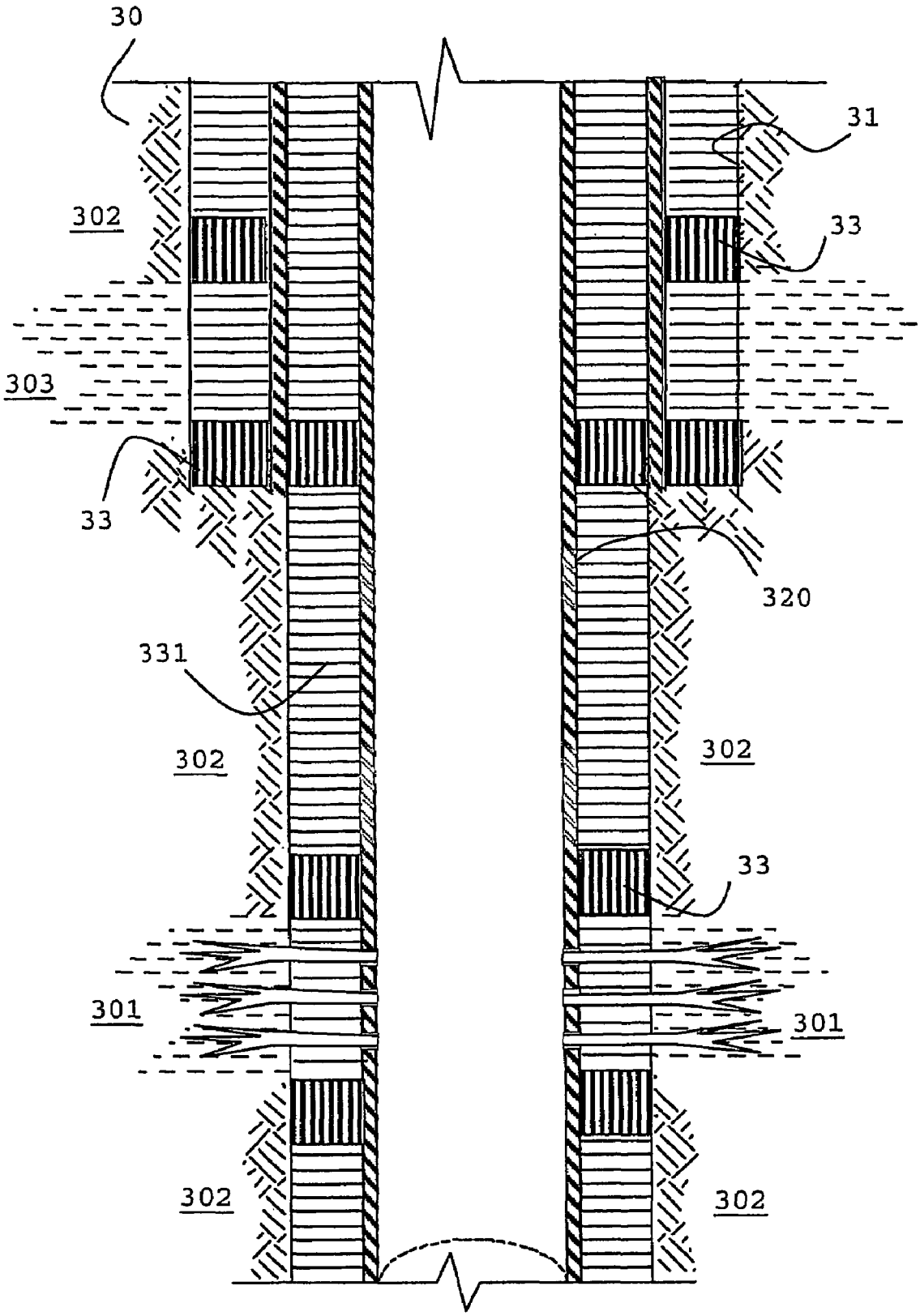
FIG. 3A shows a zonal isolation system in accordance with an example of the invention.

A schematic drawing of a mode for carrying out a system for maintaining zonal isolation in a wellbore in accordance with an example of the present invention is illustrated in FIG. 3A. As in FIG. 1, there is assumed a formation 30 traversed by a wellbore 31 penetrating through permeable 301, 303 and essentially impermeable 302 layers. To isolate the producing layer 301 from other layers 302, 303 of the formation 30, a plurality of relatively short sealing rings 33 have been placed in the annulus between a casing 320, 321 and the formation or between two casings 320, 321. A supporting matrix material 331 is used to support the casing 32 and the sealing elements 33 within in the well bore 31.

Figure 3B:
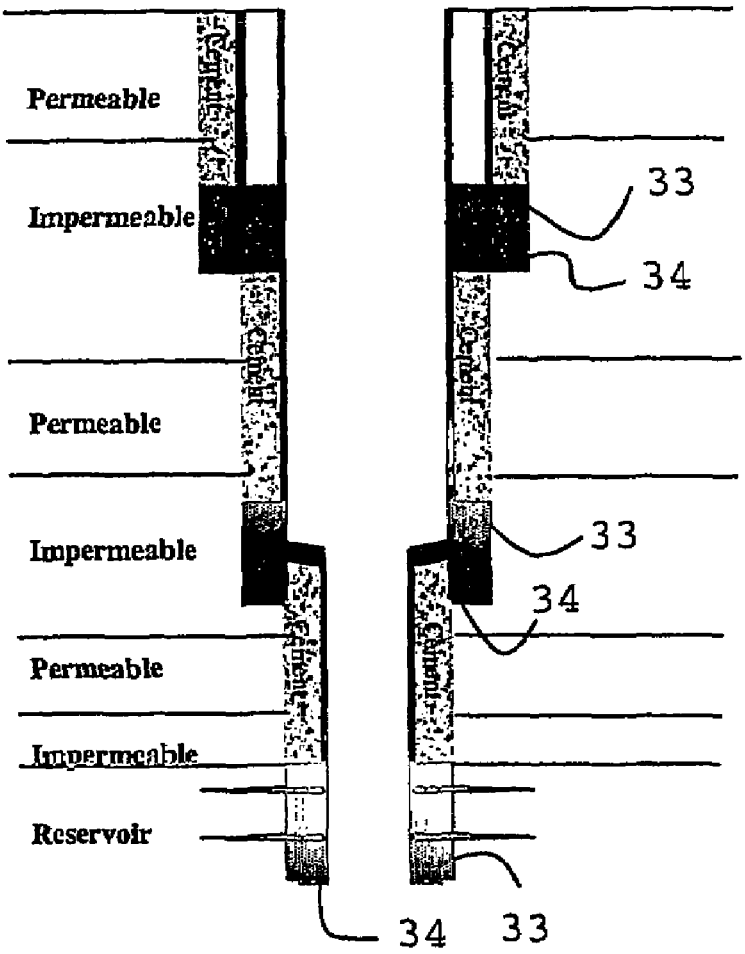
FIG. 3B shows a zonal isolation system in accordance with an example of the invention with placement in the vicinity of terminal section (shoes) of casing.

A special case of FIG. 3A is illustrated in FIG. 3B, where the sealing elements 33 are placed at the end of a casing string in the vicinity of the casing shoes 34. As the majority of casings are set with the shoe in an impermeable zone, placement of the sealing element at these locations should prevent leakage of fluids from below into the corresponding annulus. If the following section passes through permeable, fluid-bearing zones and is completed with a casing that runs to surface, however, and assuming that the conventional cement does not provide an adequate seal, the potential remains for fluids to pass up the narrower annulus and to surface unless a sealing means, such a as packer, also is placed between the two casings. If the following section is instead completed with a liner, then the only path for fluid migration that is not sealed by the sealing element is past the liner seals and into the well. Such a leak can be controlled for example by conventional packers.

It will be appreciated that, by applying the novel method and system of the invention, the use and importance of the supporting matrix to provide zonal isolation is greatly reduced. Though cement may remain a suitable material for the supporting matrix, its properties and placement can be optimised to enhance its supporting function at the expense of its isolating properties. In fact, the main contribution to the zonal isolation is provided by the sealing rings 33. These sealing rings are made of a material able to deform for an extended period of time after placement. This material may be in a fluid or in a solid state. If it is in a solid state, it is held under compression to prevent the flow of fluids, i.e., liquids and/or gases, through the annulus between casing and formation.

Figure 4A:
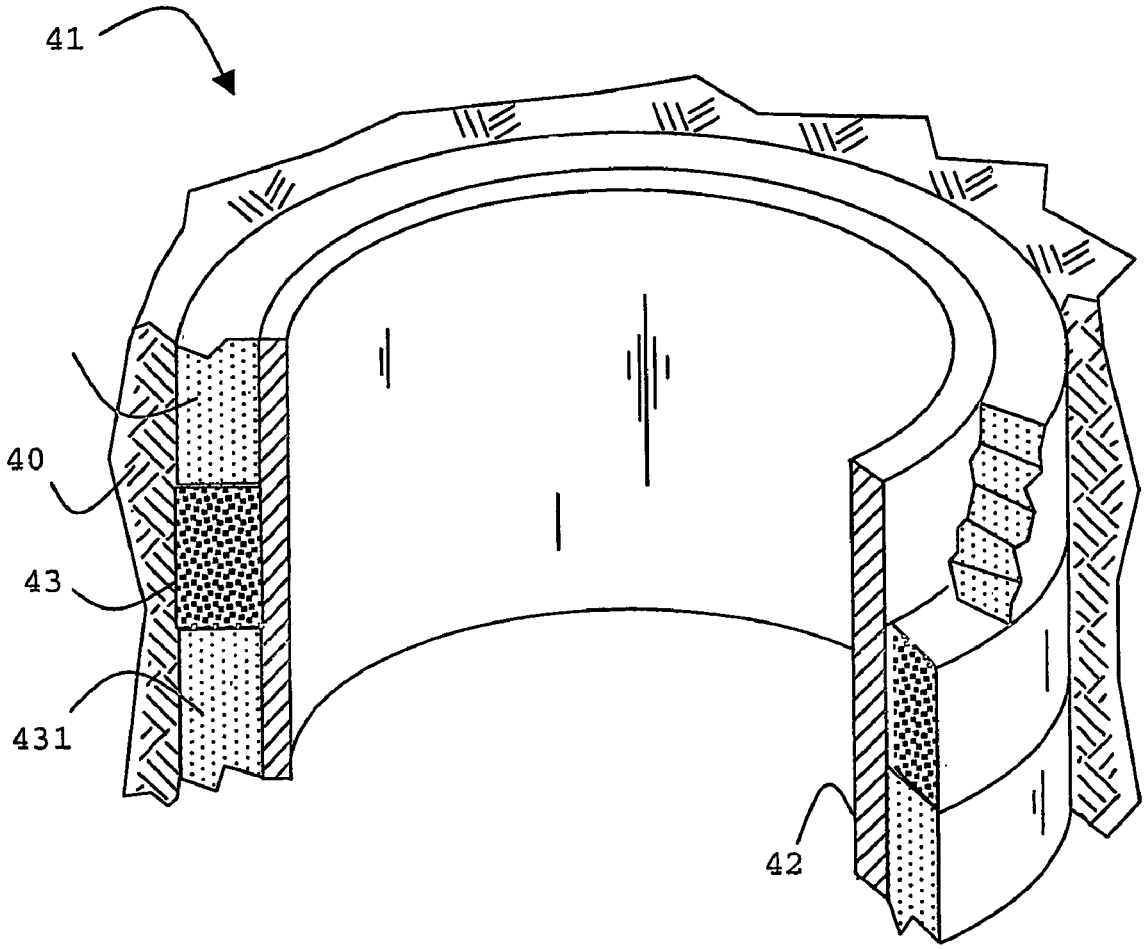
FIGS. 4A and 4B show a system in accordance with an example of the invention wherein the sealing element is a ring of deformable material.

Referring now to FIG. 4A, there is shown a section of a wellbore 41 traversing the formation 40. The drawing shows a part of the annulus between the casing 42 and the formation 40. The sealing element is a sealing ring 43 which may be made of an elastic material in compression. Above and below the sealing ring 43 that extends around the annulus, is a solid cement sheath 431 that completes the confining volume, which maintains the sealing element 43 under compression.

As the sealing material is a compressible material, it can be set into a state of compression by the hydrostatic pressure of the fluid column above. Even if the fluid column sets first, provided that it does not move and thus, the volume occupied by the sealing material remains constant, said sealing material remains under compression. Also, the compression may be established by placing expanding cement above and below the sealing ring. In yet another alternative, the casing 42 may be expanded in the vicinity of the sealing ring 43. Following both methods, the volume available to the elastic sealing element is reduced, leaving it in a compressed state so that it is able to deform to meet the conformational changes of the wellbore at its periphery.

Figure 4B:
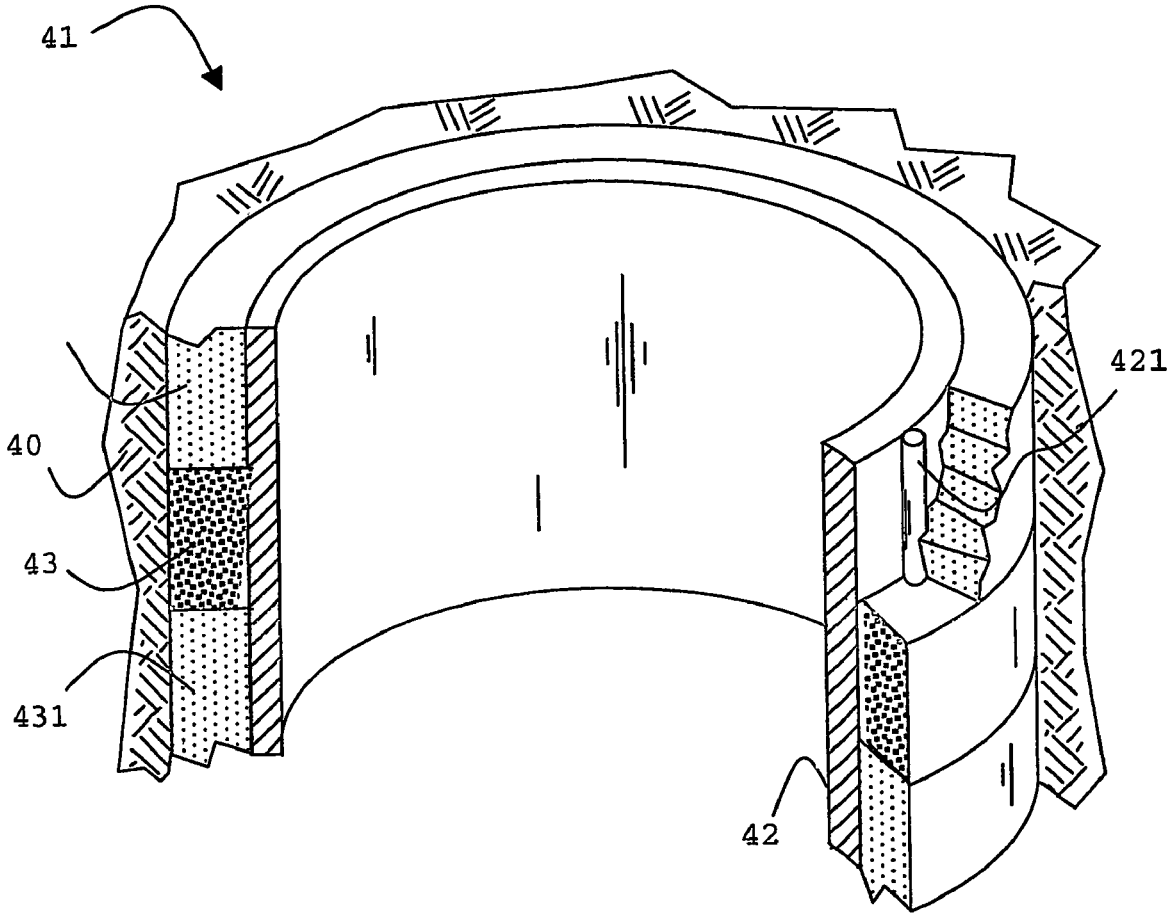

In a variant shown in FIG. 4B, using equal numerals to denote the elements corresponding to FIG. 4A, the sealing ring may be placed on the outside of the casing 42 prior to inserting said casing 42 in the wellbore 41. To obtain compression, the sealing material may include swellable material. Such swellable material could be continuously fed to the ring down a sensor channel 421 at the back of the casing 42, which displaced together with said casing. Examples of such material could be water absorbent gels such as cross-linked polyacrylate or polyacrylamide or organic swellable material such as high swell neoprene or nitrile.

The sensor line or similar fluid lines along the casing can serve as a fluid connection to continuously or in intervals pressurize the sealing ring and thus maintain it in compression.

The establishment of the compressed seal can involve a two-stage placement. For example solids-laden resin may be placed behind the casing in plug flow and the activator either encapsulated or injected in through a casing perforation under pressure. Examples of such chemistries would be based on (depending on temperature requirements) epoxy, phenolic, furan resins or styrene-butadiene block copolymer gel/resins.

Figure 5:
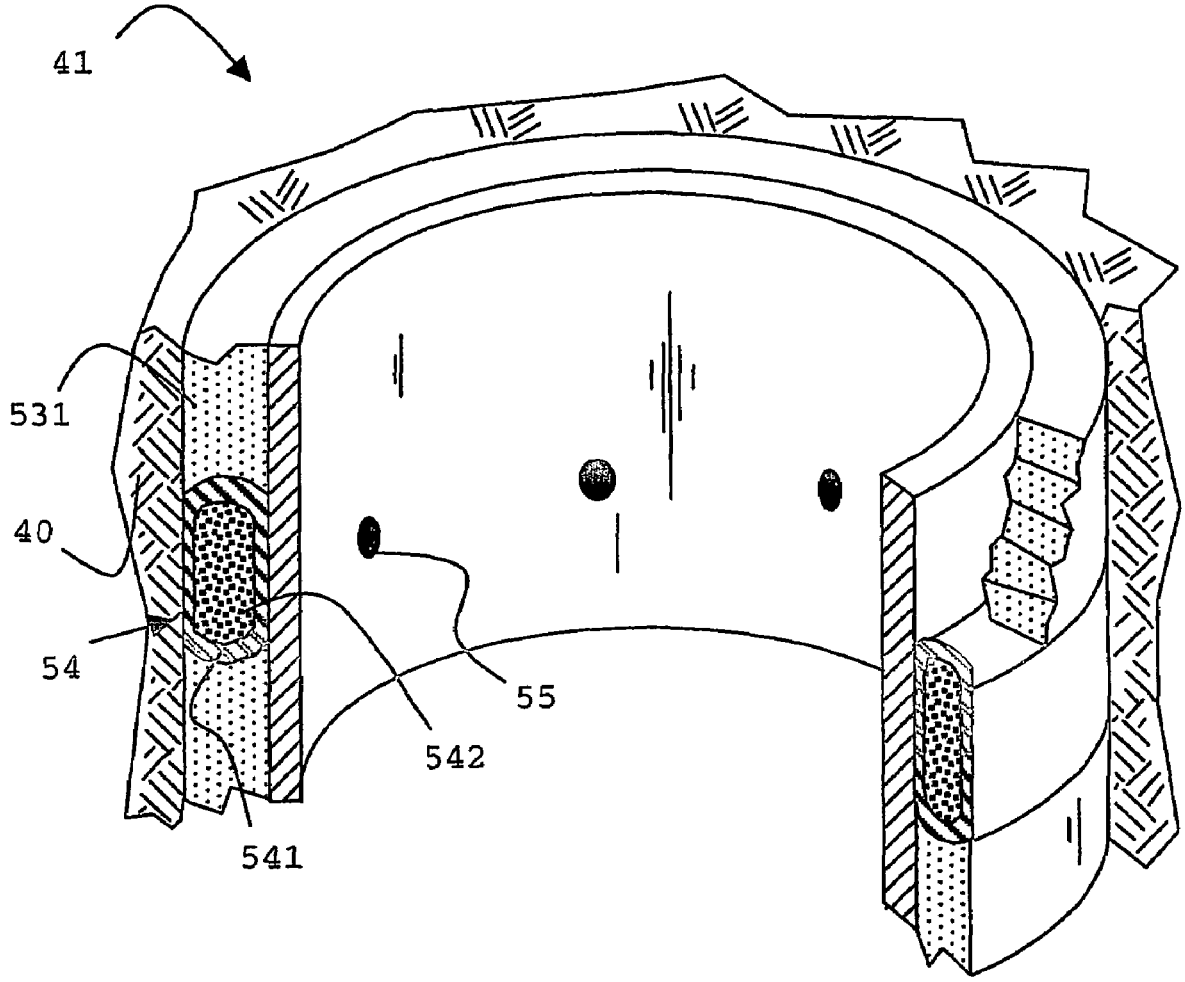
FIG. 5 shows a system in accordance with an example of the invention, wherein the sealing element is an inflatable tubular element.

In accordance with another alternative, as is illustrated by FIG. 5, the sealing element 54 is formed by a tubular element 541 made of elastomeric material. In operation, it is filled with a setting or a non-setting fluid 542. The sealing element can be placed using the methods known for external casing packers ECPs, e.g. run on the outside of a steel casing string. The tubular element can be inflated through ports 55 in the casing 52 using an inflation tool such as illustrated in FIG. 2B. The sealing element is advantageously embedded within a supporting matrix 531.

Positioning of the inflatable sealing element defines where the sealant will be placed in the wellbore. Depending on whether the sealing material is setting or not, it may not be required that the inflatable element remains intact during the process. It could be, or act like, a burst disk that is destroyed above a certain pressure allowing access of the sealant to the annulus between the casing and the formation.

As above, a positive pressure on the sealing element or sealing element zone can be maintained by a constant or intermittent supply of fluid. This fluid supply line could contain a sensor to register the pressure change in the sealing element and allow an increased supply of material should the annular gap increase.

Figure 6A:
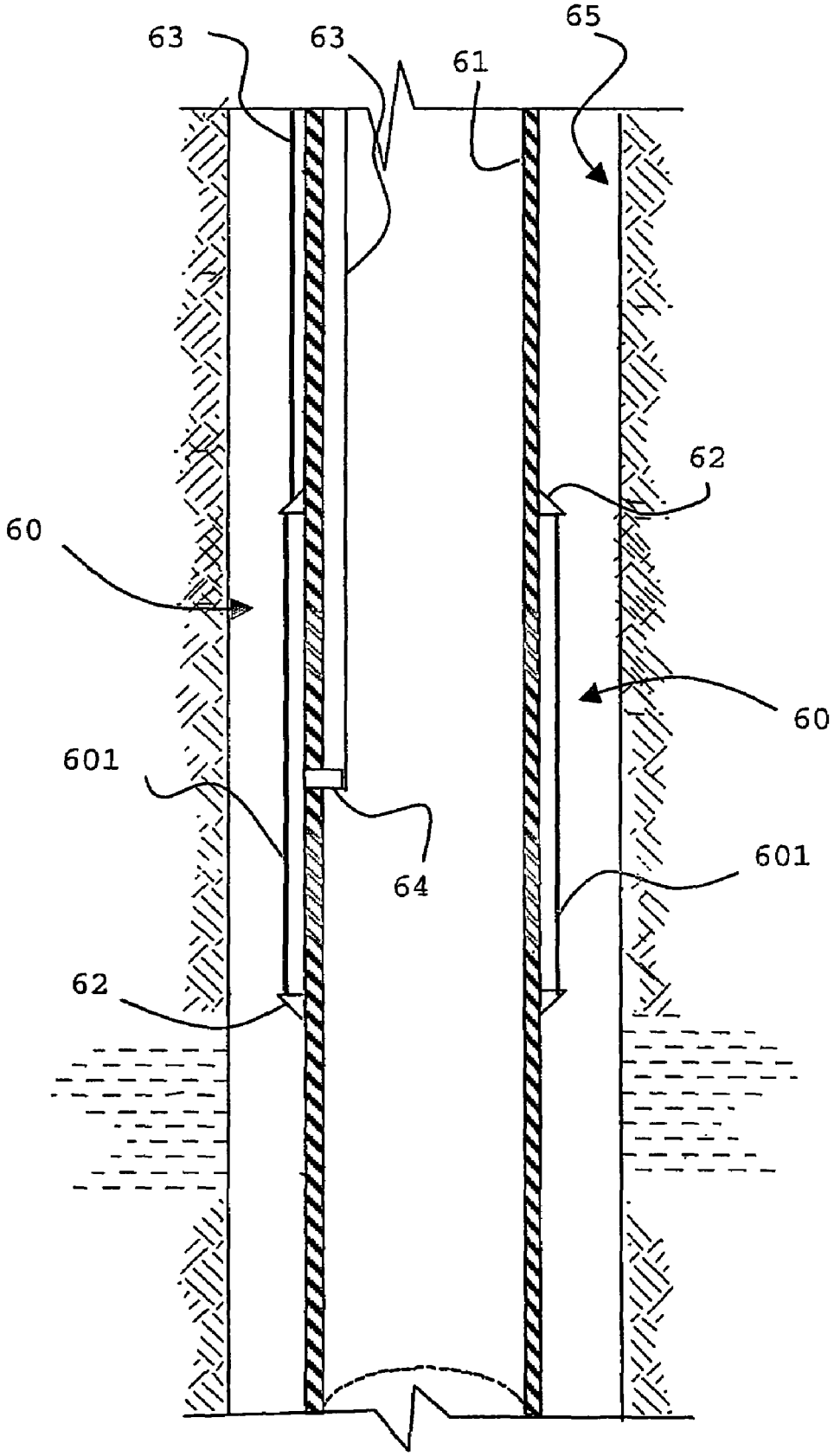
FIGS. 6A and 6B show a system in accordance with an example of the invention, wherein the sealing element comprises an inflatable membrane.
Figure 6B:
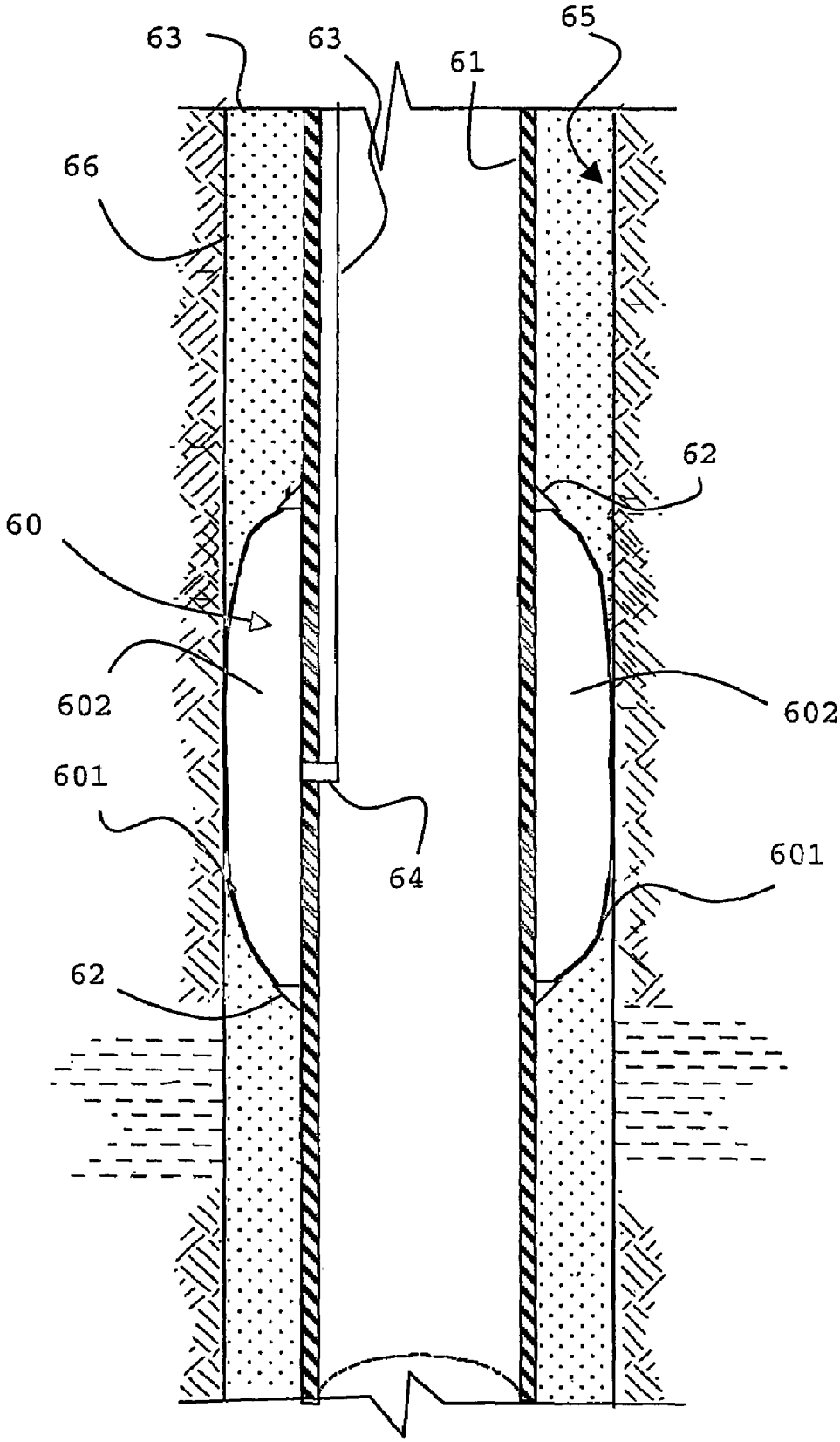

FIGS. 6A and 6B show a system according to the invention, wherein the sealing element 60 comprises a flexible membrane 601 attached to the outside of the casing 61 with a pair of collars 62. This sealing element 60 is protected from damage by centralisers not shown in the figures. These centralisers are placed above and below the sealing element 60. A narrow tube, or control line 63, is connected to the sealing element and runs back to surface. This control line 63 comes out in the space between the membrane 601 and the casing 61. It is placed either inside or outside the casing 61. In the case where it is placed inside the casing, the casing comprises a port 64 and the control line is connected to said port. The casing is lowered into place together with the sealing element in its deflated state (FIG. 6A). Then, a conventional cementation of the wellbore 65 is achieved. When the cement 66 has been placed, the sealing element 60 is inflated, via the control line 63, with a sealing material 602, which is initially fluid, but which sets to a compressible elastomeric solid. The cement is efficiently displaced by the expanding sealing element because the pressure in said sealing element is higher than the annular pressure. The material prior to setting has to be fluid enough to be pumped in place down the control line. In order to ensure a good seal with the formation wall, a membrane, permeable to the sealing material once either a certain differential pressure or expansion is reached may be used. As a result, when this differential pressure or expansion is reached, the sealing material passes through the membrane and makes contact with the formation wall. The sealing element according to the present mode for carrying out the invention does not have to grip tightly against the formation to sustain a large pressure differential. Once inflated, the integrity of the sealing element is not critical provided that the mixing between cement and sealing material is prevented before setting. If the sealing material presents a sufficient bulk compressibility and does not shrink on setting, then, it remains in the desired compressed state once the cement has set as a result of the initial hydrostatic pressure of the cement column, provided that there is no axial movement of said cement column that would relax the constraints on the sealing element. If the control line is efficiently flushed after placement, it could be used later to monitor local pressure and thus the integrity of the sealing element and/or for squeezing further sealing material, if necessary.

Alternatively, the sealing element may comprise an inflatable or swellable elements placed in the annulus, independently of the casing, using for example reverse circulation. This element is inflated or swells and, thus, seals off the formation at a right position in said annulus.

In the following, further sealing elements comprising a yield stress fluid are described. The composition of the yield fluid and other components of the sealing element may vary widely depending on the conditions encountered in the wellbore. To be effective in this application, the yield stress fluid constitutes advantageously an essentially continuous phase in the specific sealant area between the casing/tubing and the formation. The term "continuous phase" implies that the fluid phase has relatively high mobility within the sealant composite. This mobility is important at the specific areas where the seal is required. Thus, fluid phase continuity and its sealing effect is conserved upon dimensional changes in the wellbore. For example, conditions and events that would lead to formation of a microannulus in a conventional cemented wellbore, e.g., between the casing and the cement, equally creates pathways for liquid mobility to allow the fluid to seal the crack.

The fluid continuous phase needs to be present to the extent that a sufficient quantity of yield stress fluid can respond to dimensional changes in the wellbore and move to seal or maintain the seal in said wellbore. The yield stress fluid is stable under the downhole pressure and temperature conditions. It is environmentally acceptable for use in the oilfield as required by local regulations. It is preferred that the yield stress fluid is compatible with cement. Also, the yield stress fluid should not be converted to an elastic solid. It is not required that the fluid continuous phase material be a liquid at surface conditions. For instance, the sealing material could be added as a solid at the surface, either because it is a material that melts to form a yield stress fluid under downhole conditions, because the material has been encapsulated in order to facilitate adding and mixing, or because the final fluid will be formed by some downhole reaction such as hydrolysis or oxidation.

Examples of useable fluids include, but are not limited to: fluorocarbon oils or greases such as those available from DuPont under the Krytox trademark (examples may include Krytox GPL 225 for temperatures below about 200° C. and Krytox 283AC or Krytox XHT for higher temperatures), silicone oils such as those available from Dow or Rhodia, environmentally-friendly glycol ether-based oils available from Whitaker Oil.

The fluid can contain a number of different additives or non-continuous components. The term non-continuous in this case is used to differentiate a high volume component from the fluid continuous phase. The "non-continuous phase" may, in fact, be continuous, for example, systems comprised of two mutually continuous phases.

The component present in high volumes in the system may provide structural support, may protect the metal casing or tubing from corrosion, or may be inert. Examples include cement (class G, micro cements, flexible cements, expanding cements, tough cements, low density cement, high density cement), sized sand or ceramic proppant, inert solid polymer particles, and the like. From these materials, cement is preferred.

Furthermore, the fluid phase may contain a micron to submicron sized particulate material that can help clog micropores or other flow paths with a small diameter. Such particulate material can also be used to modify the rheological properties of the yield stress fluid phase for example by increasing the apparent viscosity, increasing the flow resistance, and/or increasing the maximum temperature stability. The particles may also tend to migrate to the formation or metal surface to improve the seal. Examples of particulate material include molybdenum disulfide (available from T.S. Moly-Lubricants, Inc), graphite (available from Poco Graphite), nano-sized clay particles (available from Nanocor, Inc).

In addition, the fluid phase may contain particulate material that is physically or chemically reactive to low molecular weight hydrocarbons or carbon dioxide. Preferentially, the materials would absorb low molecular weight hydrocarbons or carbon dioxide and increase in volume to fill any adjacent void volume. Examples include swellable rubbers. These materials are typically not fully vulcanised and can swell up to about 40% of their initial volume on exposure to low molecular weight hydrocarbons.

The fluid phase may also contain fibres. Such fibres can modify the apparent rheology of the fluid phase. This may help maintain the continuity of the seal fluid in cases where the sealant is placed as part of a sequence of fluids.

This may also help ensure coverage from the casing/tubing to the formation or facilitate the suspension of other solids. The fibres could be impregnated with other materials, such as biocides. An example of this is Fibermesh fibres impregnated with Microban B available from Synthetic Industries.

The fibres will have an aspect ratio (length over diameter) greater than 20, and preferably greater than 100. While there is no inherent limitation on fibre length, lengths between ⅛ inch and about 1.25 inches are preferred. Lengths between ⅛ and about 0.5 inches are especially preferred. The fibres should be stable at least during the placement/pumping period, but preferably for more than 1 week under the downhole conditions. Fibre diameter in the range of from about 6 to about 200 microns is preferred. The fibres may be fibrillated. They may range in geometry from spherical to oval to multilobe to rectangular. The surface may be rough or smooth. They may be formed of glass, carbon (including but not limited to graphite), ceramic (including but not limited to high zirconium content ceramics stable at elevated pH, natural or synthetic polymers or metals. Glass and synthetic polymer fibres are especially preferred due to their low cost and relative chemical stability.

Optionally, the fluid phase will contain expanding agents. These materials can help maintain the composite under compressions. They can also help the composite to expand to fill any adjacent void volume.

A number of other additives can also be used, as known by those experienced in the art. These materials may increase fluid viscosity, improve oxidative stability over time, improve thermal stability, increase or decrease density, decrease friction pressure during flow through pipes, and the like.

The gel could be a variation of InstanSEAL (™) technology as marketed by Schlumberger comprising a mixture of water, Xanthan gum and an oil containing amounts of clay and cross-linker.

Another manifestation uses drilling fluid solidification technology. In this case, the casing is lowered into the annulus and only selected sections of the material behind the casing are converted in elastic solid.

Figure 7A:
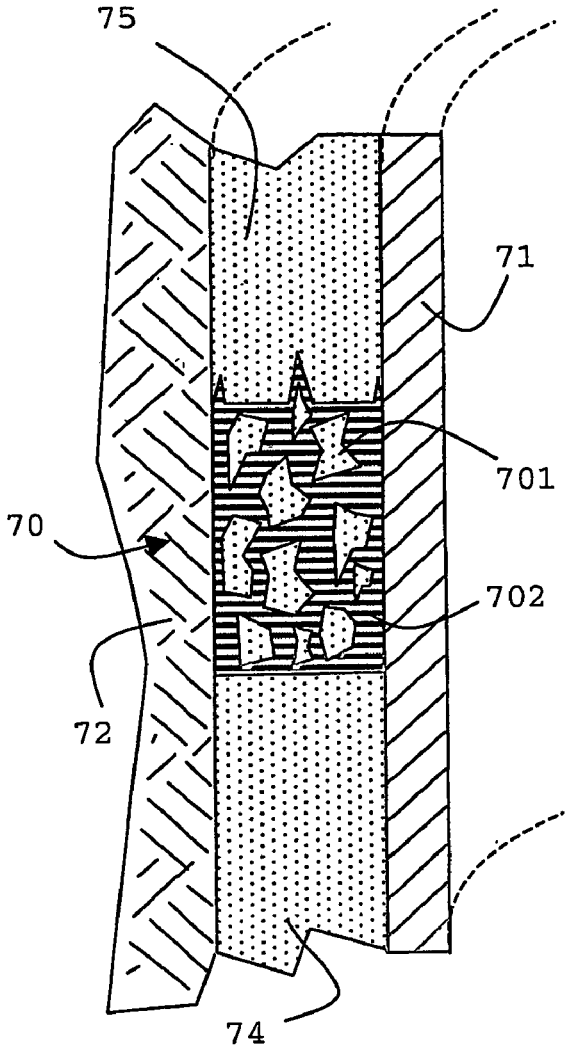
FIGS. 7A and 7B show systems in accordance with examples of the invention wherein the sealing elements comprise a liquid-continuous phase sealing material.

In a first example, as illustrated in FIG. 7A, the sealing element 70 placed between the casing 71 and the formation 72 is shown as a matrix containing pieces 701 of solid material dispersed within a gelling material 702 such as bitumen or silicone oils. The solid material may be intentionally fractured set cement, or cement disturbed before setting. Alternatively porous cement could be used as a support for a gel. The gel fills the gaps between the solid material, including cracks that may open in the matrix material below 74 and above 75 the sealing element. So, in some cases, the cement sheath and the sealing element form an intermingled, random composite material, wherein the sealing material form a continuous path between the formation and the casing (or across said casing or right across the wellbore diameter in the case of plug and abandonment) or completes a continuous path within a discontinuous cement sheath, at a specific location along the wellbore.

The gel will be added as a secondary injection either through the casing or through the annulus. The gel will be the continuous phase with a yield stress of the order of 10 Pa or higher and the material will deform plastically during casing expansion.

Figure 7B:
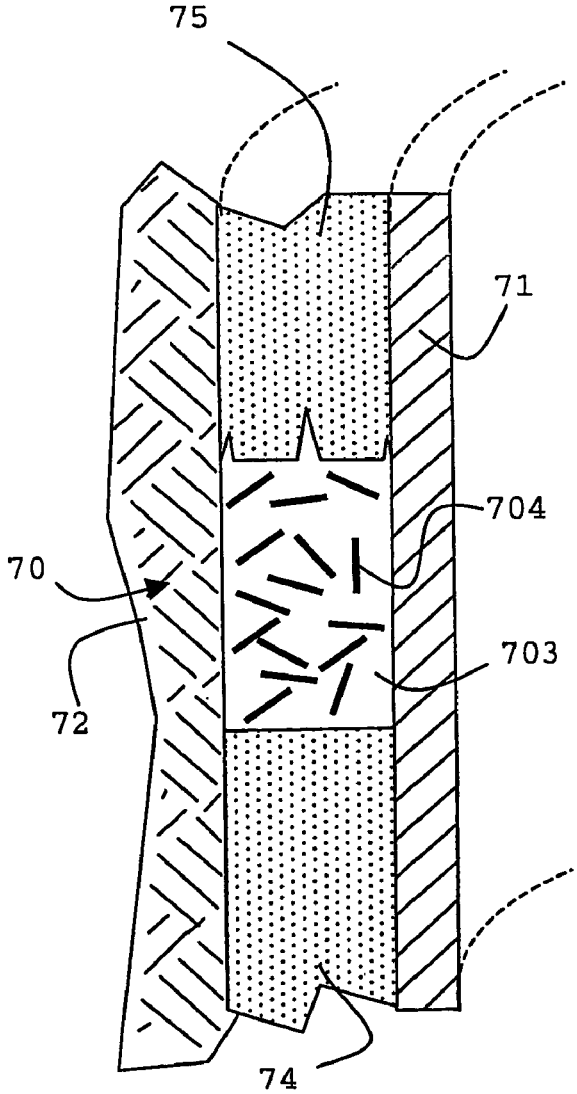

Using a gel with higher yield strength above 600 Pa, the sealing element may consist of a gel phase held in place by two supporting layers 74, 75 or plugs below and above the seal 70, as shown in FIG. 7B. The gel 703 may contain additional particulate material 704 such as fibres or flakes.

When gas migrates along the annulus of the wellbore and enters the sealing layer, it pushes the bottom of the gel upwards against the top cement plug. This compresses the gel against all surfaces and cracks and the gas is prevented from migrating further up the well bore.

Fluid-continuous phase composite sealants provide reliable seals under the most severe conditions while responding very rapidly to changes in wellbore dimensions caused by pressure, temperature, mechanical, or other shocks.

Several other methods can be used to place a fluid system in its predetermined location behind casing.

Figure 8B:
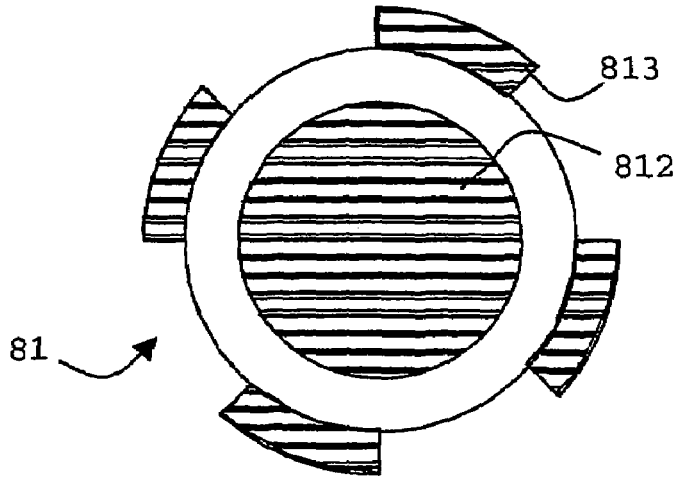
FIGS. 8A and 8B show a tool for placing a sealing element in a wellbore.
Figure 8A:
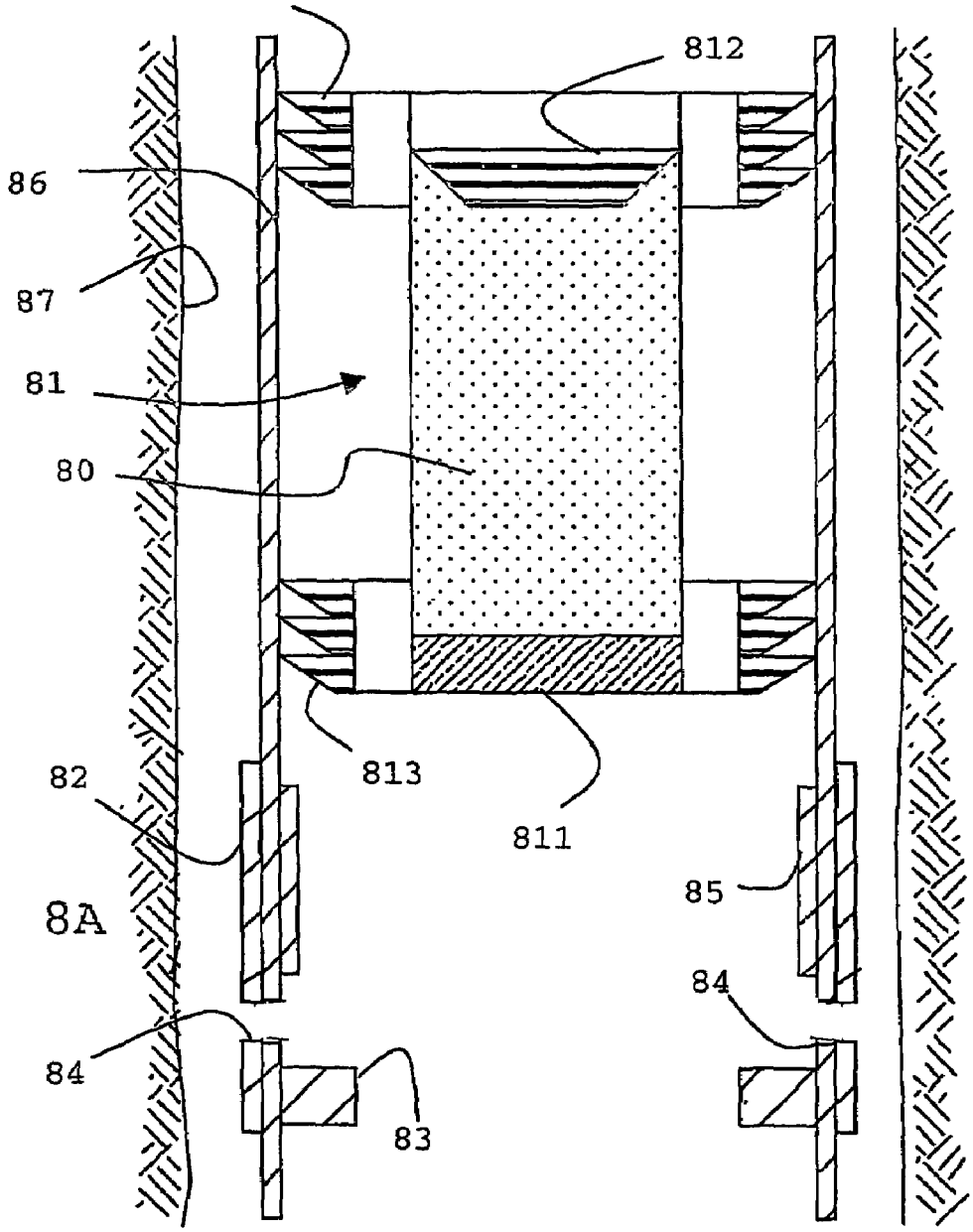

In a first delivery method, the sealing fluid 80 is transferred in a delivery tube 81 as shown in FIGS. 8A and 8B. The defined location of the seal is determined by a two-stage cement shoe 82. Above the landing collar 83 of the shoe 82, there are flow ports 84 that can be closed by sliding sleeves 85. The sealing fluid is delivered by the delivery tube 81 that has a smaller diameter than the casing 86. It is sealed at the bottom with a burst disc 811 and, at the top, with an internal wiper 812. The fluid 80 is discharged by applying a differential pressure to burst the disc 811 and pump the wiper 812 down the tube. At its lower end, the tube 81 is mounted on a cement plug 813. As the tube is pumped, inside the casing 86, down the well 87, this will help to centre it and pull it along. It will also prevent contamination of the slurry in front of the tube. At the top of the tube another cement plug 813, or other centraliser is used. While keeping the tube 81 centered, the upper plug 812 does not fill the annulus, so that any pressure exerted from above does not create a significant differential pressure between the inside and outside of the tube.

The fluid 80 is placed inside the tube 81, with a small cement plug or wiper 812 inside the tube, above the fluid. This will maintain isolation of the fluid in the tube and allow good displacement when it is pumped out. In addition, when the wiper 812 is pumped against the bottom of the tube, it will form a seal to differential pressure so the isolating sleeve 85 on the cement shoe 82 can be closed.

The mechanical properties of the tube 81 are not particularly demanding. For most of the operation it remains pressure balanced. The flow ports in the top plug 813 ensures that the tube is pulled down the well from the bottom plug rather than being pushed down. It will see a small crushing pressure, due to the frictional pressure drop in the tube, when pumping the fluid out of the tube. At that stage however the fluid inside supports the tube.

Ideally, the tube 81 is made of a material which is soluble in the well, or in such a way that it can be drilled out as part of the subsequent drilling operation.

Though aspects of the above procedure are similar to the setting of a plug, e.g. a lead cement plug, the conventional cement head will require a launcher long enough to take the full length of the tube, which is typically in the order of 30 ft.

A typical operation includes some or all of the flowing steps: assembling a two-stage cement shoe into the casing string as it is run into hole, completing a first stage cement placement, cementing up to the second shoe, dropping a dart to open second shoe, pumping a second stage wash, pumping a second stage cement, following with the delivery tube loaded with seal material, displacing with desired completion fluid, seating the tube into the second shoe, pumping up to burst the disk using pressure, displacing sealing material from the tube, seating wiper into the bottom of the tube, pumping up to close isolation sleeves;—allowing material to set, and allowing the tube to be dissolved, or drill it out as part of a subsequent drilling operation.

Figure 9:
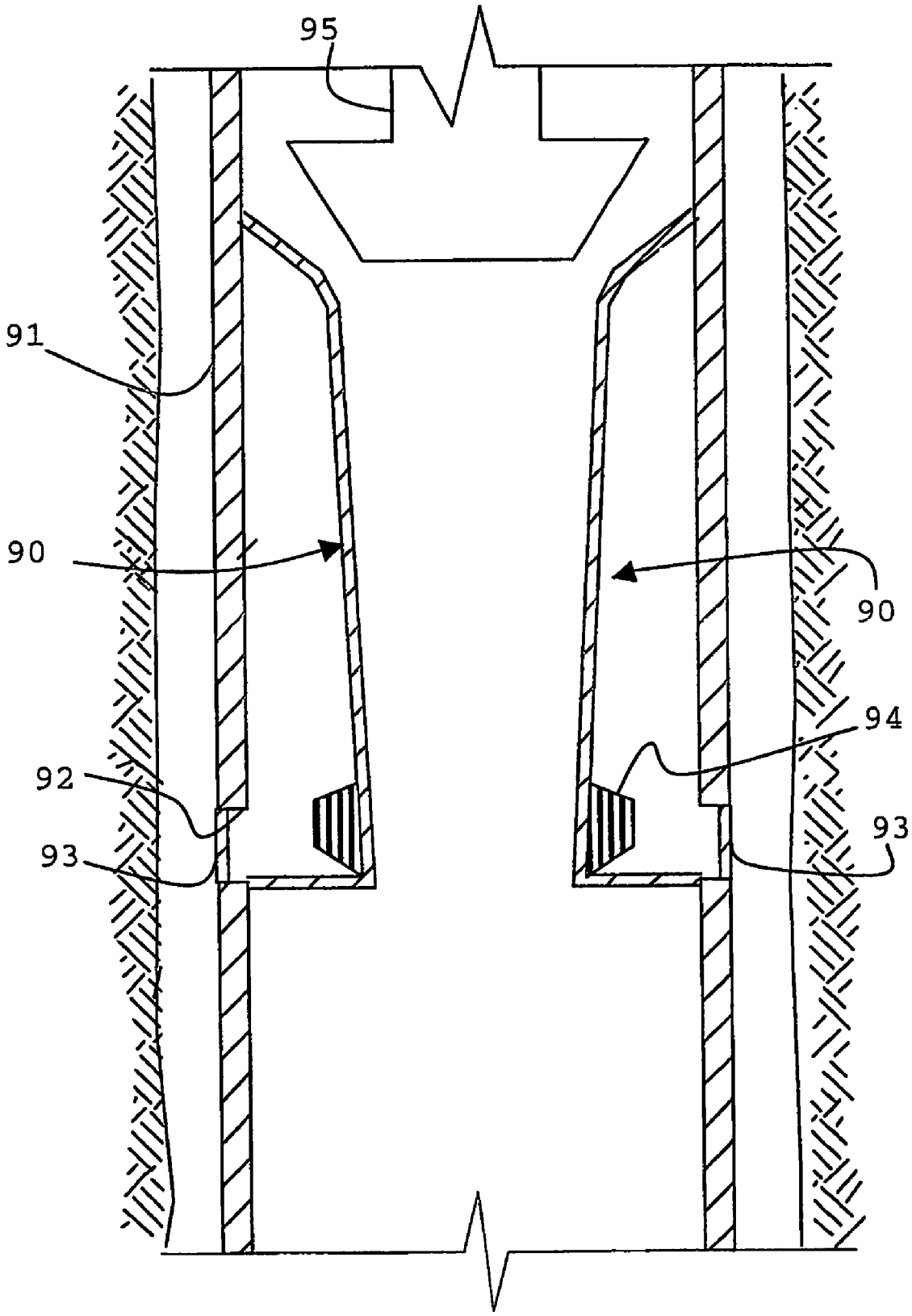
FIG. 9 shows another tool for placing a sealing element in a wellbore.

Alternatively, the sealing liquid may be transferred to the downhole location in containers that are attached to or integral part of the casing string. This variant, as shown in FIG. 9, comprises casing tubes with one or more fluid reservoirs 90 located at the inner circumference of the casing 91. These reservoirs 90 are assembled together with the other parts of the casing 91 at the surface and subsequently lowered into the wellbore 92.

When the casing string is placed, a tool 95 can be lowered into the casing 91 that collapses the inner wall of the sealant reservoir 90 forcing the fluid through port-holes 92 in the outer wall of the casing. During placement, the port-holes are protected and sealed by burst discs 93. The inner reservoir wall may be made of thin metal sheets and may conveniently carry a plug element 94 opposite of the port-hole 92. With the tool action, the plug element 94 is forced into the port-holes 92 forming thus closing the hole after the passage of the sealing fluid.

The reservoirs can be placed anywhere along the length of the casing string. This removes the possible requirement to modify a casing point when placing the sealing material.

Figure 10:
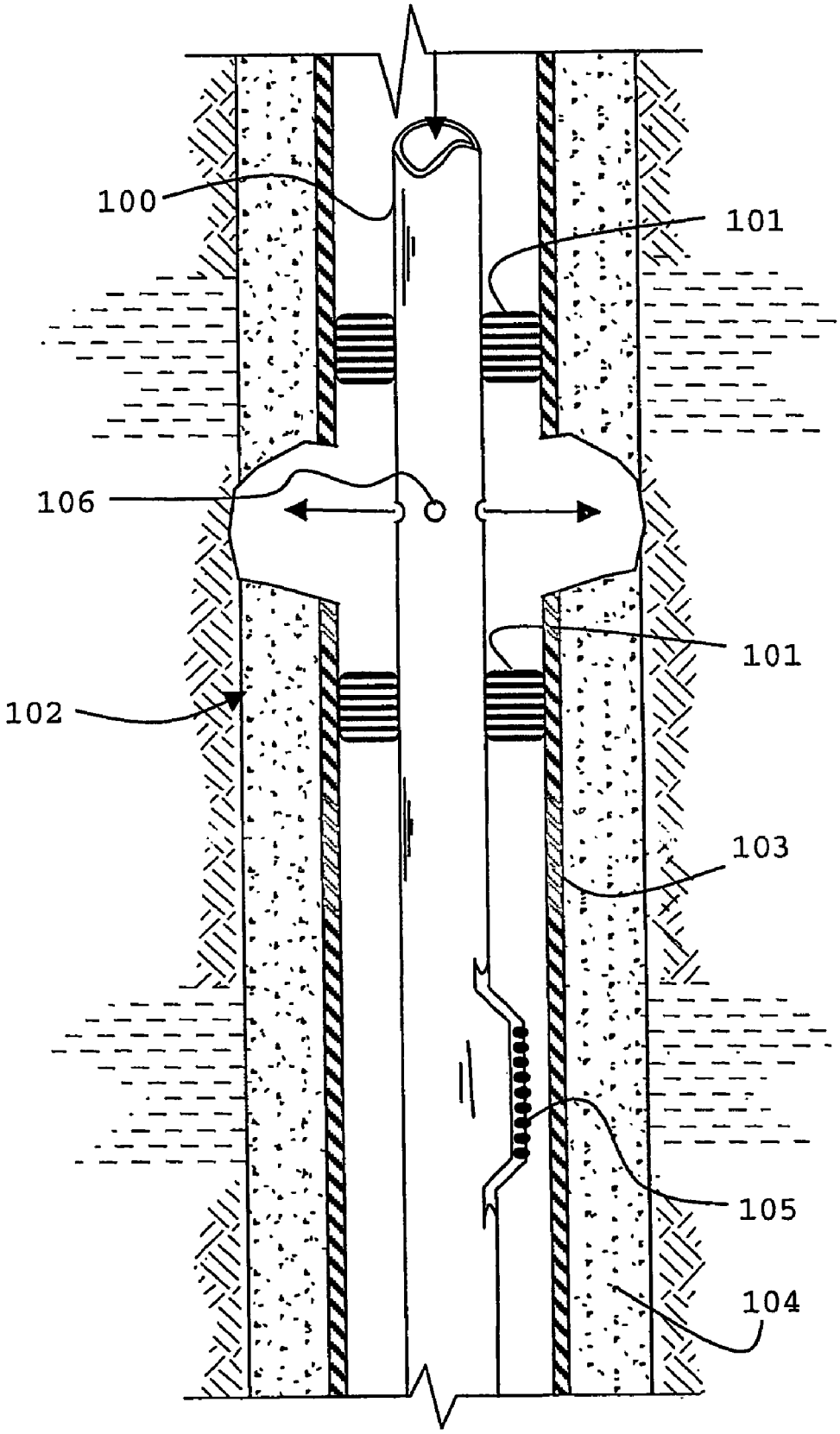
FIG. 10 illustrates another placement method for a sealing element in accordance with an example of the invention.

To place a sealing element behind avoiding modification of a particular casing point, a portion of casing and cement may be removed or crushed. This operation is routinely performed using cutting, perforating or drilling tools. In FIG. 10, such a tool is shown mounted on a coiled tubing string 100. A straddle packers set 101 is mounted on the coiled tubing string, above and under the cutting tool 105. In-between the packers, the tubing string 100 has ports 106 to allow the passage of fluids from the inner of the tubing string into the wellbore 102.

After cutting through the casing 103 and cement 104, the cutting tool is then moved forward and the packers are inflated above and below the cut zone thus isolating the sealing section from the rest of the wellbore. Sealing material is then squeezed through the tubing and the ports into the cut-out section behind the casing and allowed to harden. After the fluid placement, the packers 101 are released and the tool is withdrawn. To close the casing, a casing patch is then run into the well and inflated over the treated zone to provide support for the sealing material.

According to another mode for carrying out the invention, the sealant composition can be pumped directly down the annulus between the metal casing and the formation. In this case, the sealant can be pumped by itself or as part of a fluid train that includes, for example, conventional cement, expanding cement, different sealant compositions, or the like.

In a variant of this placement method, the sealant could be placed by pumping through perforations, slots, or other gaps in the well tube. In this case, the area between the casing and the cement could be initially filled with a liquid, with a weak cement (such as a porous cement, or low density cement) or a gas. In general, the sealant would be pumped through some holes or gaps in the casing or liner and the original material would leave through others. Procedures to accomplish this are well known to those experienced in the art. As above, the sealant could be pumped alone, or as part of a fluid train.

When sealant is pumped as part of the fluid train in normal cementing operations, no additional downhole equipment is required. The operator can switch between pumping cement and pumping the sealant as required to form a reliable seal.

Figure 11A:
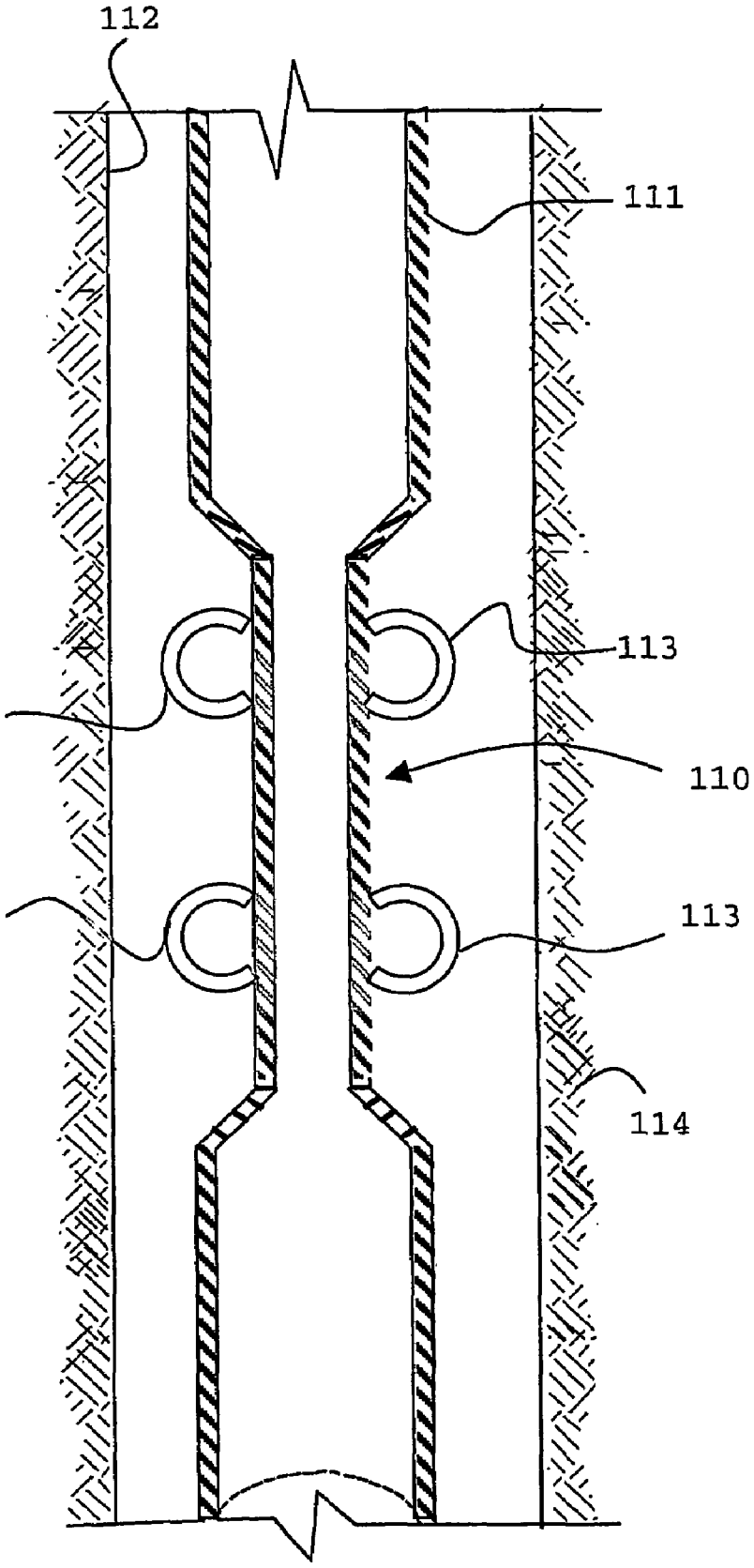
FIGS. 11A and 11B illustrate the placement of a sealing element according to the invention, using an expandable casing.
Figure 11B:
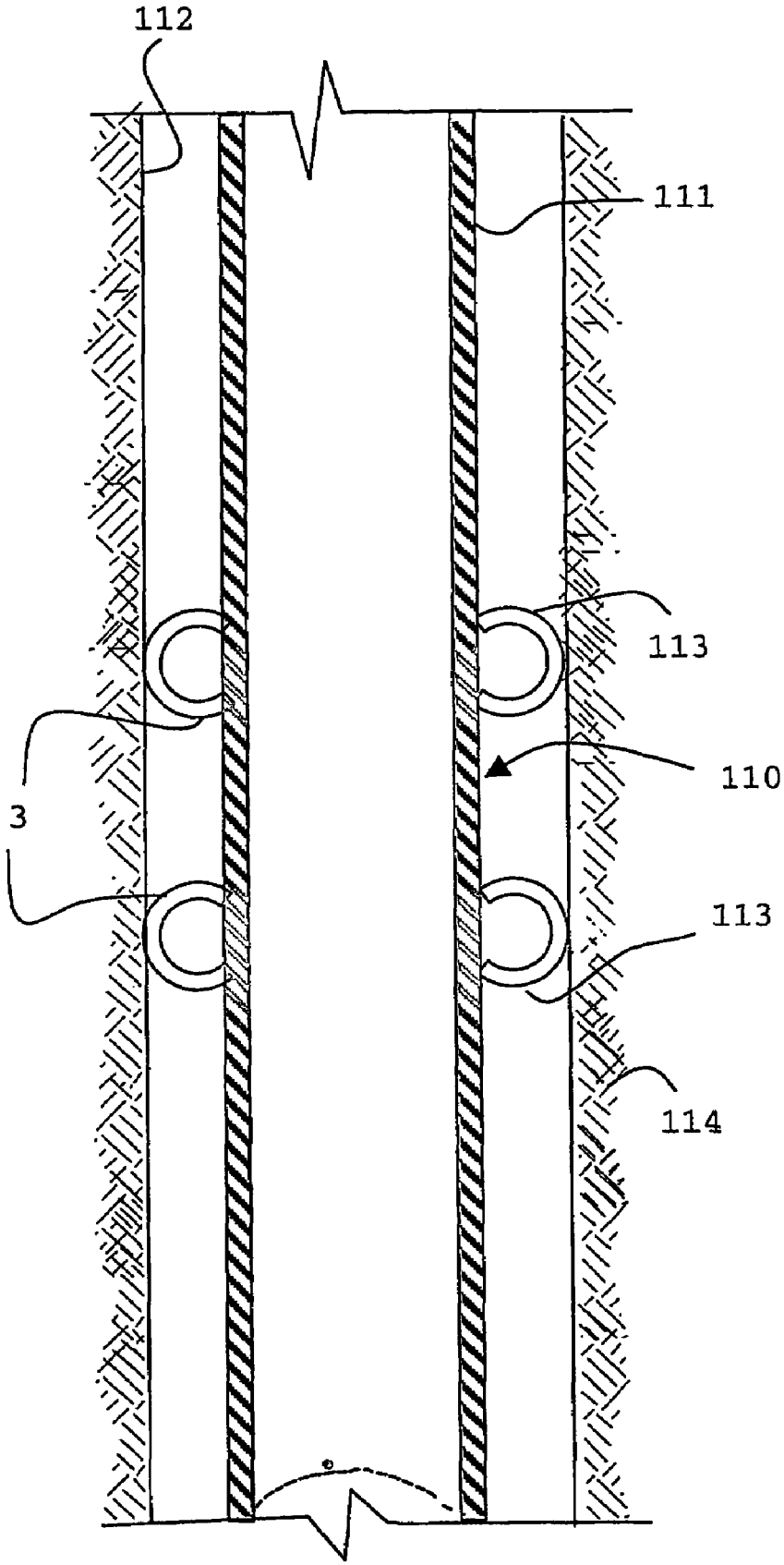

As shown in FIGS. 11A and 11B, a section 110 or sections of an expandable tubular can be contained in a conventional casing string 111. The string 111 is run into the borehole 112 with expandable sections 110 in a collapsed form, having a smaller internal diameter than the internal diameter of a conventional casing. Located on the outside of the expandable sections are the sealing elements 113 which form O-rings of such size that the entire section of tubular and the sealing element does not have a greater outer diameter than the adjacent conventional casing. The expandable sections 110 are positioned in such a way that, when the casing is landed, they are located adjacent to the zones where zonal isolation is required. After landing, a mandrel or other opening tool is run inside the casing to expand the expandable sections 110. The internal diameter of the expanded sections now equals the internal diameter of the conventional casing and the O-ring shaped sealing elements 113 are forced against the formation 114, providing a seal (FIG. 11B). In an alternative form, chemical sealants are released from bags that are ruptured during expansion. These can react with other agents delivered in bags or with a fluid already in the annulus to form an elastic sealing material.

Plug and abandonment operations may require different procedures. In some cases, the sealant is bull headed down the well bore. This may be preceded by pumping a train of fluids to clean the tubulars in the wellbore, and/or to help improve the quality of the seal between the metal and the sealant. Pumping the sealant may be followed by pumping of cement or other material. This may be done to fill the rest of the desired zone. It may be done with a high density material to maintain a compressive force on the sealant material. One or more types of sealants may be used in the process. They may be pumped in sequence of may be separated by cement or other desired material.

To improve the sealing, it may be required to drill into the formation, thus creating a clean surface for the bond between the sealant and the formation. Alternatively or additionally, perforations into the formation could be formed as an anchor for the sealant. Optionally, a train of fluids can be pumped to clean and pre-treat the formation to facilitate formation of a strong bond between the sealant and the formation. The sealant can then be placed as above, or by coiled tubing, or other methods known to those experienced in the art. As above, the sealant can be followed by other materials. This process can be repeated in a number of zones.

In remedial treatments, it is conceivable that the sealant would be pumped into the annulus between the cement and the formation or the cement and the casing/tubing or into any fractures that would develop in the cement sheath. In this case it is desired that the sealant forms a continuous barrier in the area in which it is pumped.

In fact, remedial actions may often be necessary and sealing elements may be periodically reinforced or reactivated by injection/release of fluid components internally, through the casing or by direct injection down the annulus.

For the above described methods, the sealing material may be based upon common elastomeric materials such as natural rubbers, acrylic rubbers, butadiene rubbers, polysulphide rubbers, fluorosilicone rubbers, hydrogenated nitrile rubbers, (per)fluoro elastomers, polyurethane rubbers, non-aqueous silicones and silicone rubbers, or cross-linked polyacrylamides. Further polymeric compounds suitable as sealing material include poly-diallyldimethylammonium chloride (polyDADMAC), a cationic water-soluble polymer, which crosslinks readily using for example N,N' methylene bisacrylamide as linking agent.

Particularly suitable materials with a low viscosity during placement and low set modulus material are epoxy resin products, for example linear low molecular weight oligomeric polypropylene glycol terminated with an epoxy group at each end.

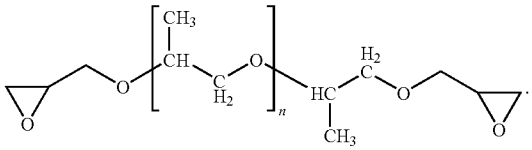

Amine crosslinking compounds can be used to link the epoxy resins, for example 2-methyl pentanediamine, m-xylene diamine; tetraethylene pentamine, diamino polypropylene glycol, diethylmethyl benzenediamine, derivatives of tall oil or mixture thereof. The epoxy resin curing reaction can be accelerated by a number of different types of compounds including organic acids and tertiary amines.

The sealing element may be a composite material comprising an elastic solid material and/or a dispersed filler material. Upon setting, the elastic material may constitute a matrix in which the filler is dispersed. The filler itself may be solid or may even be a gas in order to increase the compressibility of the composite.

In order to reinforce the above epoxy resins and to minimise sedimentation problems, a very fine grade barium sulphate filler was used to increase the density of the epoxy material rather than standard API barite The Young's moduli of the set epoxy materials were measured by compressing 5 cm long, 2.5 cm diameter cylindrical samples axially using a load frame. Poisson's ratio was generally not measured, but on selected samples it was estimated either by a direct method of measuring compressibility using ultrasound or by measurement of the apparent modulus under confined conditions. All of the samples gave fairly linear stress vs. strain curves, and Young's moduli were calculated from the gradient of these curves in the stress range of $10^4$ to $10^5$ Pa (strain range 0.01-0.05).

It should be noted that all measurements were made at room temperature. It is customary for cement samples to be tested at room temperature only, as it has been demonstrated that cement moduli do not change dramatically as the samples are heated. This is unlikely to be the case for these materials. Rubbers generally become rather stiffer when heated, since the origin of their elasticity is the reduction in entropy of the polymer chains when they are stretched. Thus as temperature is increased the entropy loss per unit deformation increases and so does the modulus. Qualitative observation of samples of these filled epoxy materials, however, suggests that their moduli decrease somewhat with temperature.

With the above epoxy resin alone, the modulus was increased by a factor of approximately 3 on addition of the barite filler at 65% by mass (solid volume fraction being approximately 0.3).

For the unfilled samples of crosslinked epoxy resin a bulk modulus (1/compressibility) of 2.48 GPa was measured using the ultrasonic technique, and a value of 2.36 GPa was measured by axially compressing a sample held confined an open-ended, rigid steel cylinder on the load frame. These values were close to that of water (2.24 GPa) as expected. Poisson's ratio (ν) calculated from the bulk modulus (K) and the Young's modulus (E) according to the relation $\nu=(1-E/3K)/2$ is 0.4998 in both cases. Such a high value (close to its limit of 0.5) is desirable in order to maintain the material in a state of compression over its whole cross-section in the annulus.

The performance of the above epoxy compound may be further enhanced using a blend of epoxy resins, for example a mixture of the above polypropylene glycol based resin with trimethylolpropanetriglycidyl ether:

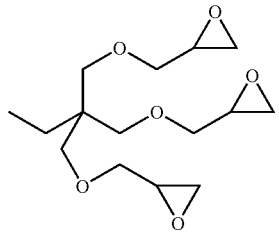

Depending on filler content and volume ratio of the blend, Young's moduli can be set to be with the range of 2.6 to 70 Mpa. With a pure filled epoxy of trimethylolpropanetriglycidyl ether it is possible to set the modulus to as high as 608 Mpa.

EXAMPLE 1

Comparative Example Using Oilwell Cement

A sample of Class G oilwell cement was mixed with water at a water/cement ratio of 0.44 (density=16 ppg). The mixture was poured into a 1 inch diameter steel tube with a pressure valve at its lower end. After pouring the cement a similar valve was attached to the other end and the tube was heated to 80° C. and pressurised to 2000 psi. After leaving the material to set for 24 hrs the pressure was released, and the upper valve removed. The space above the set plug of cement was filled with a hydraulic oil, and the valve replaced. The valve at the lower end of the tube was kept open, and the pressure of the hydraulic oil at the upper end of the tube was then increased to 3000 psi. Leakage of oil past the plug of material was observed after a short time at a rate of approximately 2 ml/hr.

EXAMPLE 2

70 g barium sulphate (Microbar 4C from Microfine Minerals, UK), 30 g of epoxy-terminated polypropylene glycol (Epikote 877 from Resolution Products) and 8.3 g of an amine-based crosslinker (Epikure 3055 from Resolution Products) were mixed together in a Waring blender. The resultant formulation had a viscosity of 530 cP at a shear rate of 100 $s^{-1}$. After heating to 80° C. the formulation viscosity was reduced to 105 cP at the same shear rate. The mixture was poured into a 1 inch diameter steel tube with a pressure valve at its lower end. After pouring the formulation a similar valve was attached to the other end and the tube was pressurised to 2500 psi to set the material into a state of compression. After leaving the material to set for 24 hrs the pressure was released, and the upper valve removed. The space above the set plug of material was filled with a hydraulic oil, and the valve replaced. The valve at the lower end of the tube was kept open, and the pressure of the hydraulic oil at the upper end of the tube was then increased to 3000 psi. No leakage of oil past the plug of material was observed over an extended period.

Using the above method of establishing the Young's modulus, a modulus of 10 Mpa was measured for this example.

EXAMPLE 3

A similar experiment to that described in Example 2 was carried out, in which the walls of the steel tube were first roughened with glass paper and a thin film of a water-based drilling fluid was applied to the inside surface of the tube. A sample of the formulation described in Example 2 was then poured into the tube and it was pressurised and tested in the same way. Again, no leakage of oil past the plug of material was observed over an extended period at a pressure differential across the sample of 3000 psi.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limitating. Various changes to the described embodiments may be made without departing from the spirit and scope of the invention.

The invention claimed is:

1. A system for maintaining zonal isolation in a wellbore, characterized in that said system comprises, within a pathway at a specific location along said wellbore, a sealing element to block said pathway, said sealing element being able to deform both during and after placement and wherein the sealing element is maintained under compression after completion of the placement, thereby urging the deformable sealing element into contact with less deformable material bounding the pathway so as to maintain a seal against fluid migration along the pathway, wherein the sealing element is a sealing ring, said sealing ring being confined in a volume surrounded by materials of high Young's modulus, greater than 1000 MPa, comprising well tubing, formation surrounding the wellbore and cement injected into the wellbore, said cement injected into the wellbore comprising a first sheath portion and a second sheath portion, wherein the sealing ring comprises a sealing material which has a Young's modulus below 1000 MPa., is contained between and contacts said first sheath portion and said second portion and is connected to a fluid communication element adapted to supply pressurizing fluid after placement and thereby maintain pressure within at least part of the sealing element.

2. The system of claim 1, wherein the sealing element comprises a sealing material in a solid state.

3. The system of claim 1, wherein the sealing element comprises a sealing material which approximates the behaviour of an elastic solid.

4. The system of claim 1, wherein the sealing element comprises a sealing material in a liquid state.

5. The system of claim 1, wherein the sealing element comprises a sealing material, said sealing material being a yield stress fluid.

6. The system of claim 5, wherein the yield stress value of the sealing material is greater than 10 Pa.

7. The system of claim 1, wherein the sealing material is visco-plastic.

8. The system of claim 1, wherein the sealing material is visco-elastic.

9. The system of claim 1, wherein said sealing material is enclosed by an inflatable membrane.

10. The system of claim 1, wherein the sealing element is able to deform for more than 5 years after placement.

11. The system of claim 2, wherein the sealing element is designed to deform for the planned life time of the well.

12. The system of claim 1, wherein formation surrounding the wellbore comprises at least a first layer and a second layer, said first layer being essentially impermeable and said second layer being permeable and wherein the sealing element is at least partially placed adjacent to the first layer.

13. The system of claim 1, wherein the cement injected into the wellbore comprises material that expands after placement.

14. The system of claim 1, wherein the average height of the sealing element, measured along the wellbore axis, is less than approximately 150 m.

15. The system of claim 14, wherein the average height of the sealing element, measured along the wellbore axis, is less than approximately 60 m.

16. The system of claim 15, wherein the average height of the sealing element, measured along the wellbore axis, is comprised between approximately 1 m and approximately 30 m.

17. The system of claim 1, wherein the sealing element comprises a sealing material, which is sufficiently fluid prior to placement to be pumped or injected at a specific downhole location, and sets under pressure to a deformable solid or a yield stress fluid.

18. The system of claim 17 wherein said sealing material expands during solidification or gelation.

19. The system of claim 17, wherein the sealing material is maintained under compression by cement sheath portions.

20. The system of claim 17, wherein the sealing element is compressed by expanded parts of a well tube.

21. The system of claim 1, wherein the sealing element consists of a chemical compound that homogenously fills the volume.

22. The system of claim 1, wherein compression results from the hydrostatic pressure of the liquid/yield fluid that forms the sealing material.

23. Use of the system according to claim 1 for plug and abandonment.

24. A method of maintaining zonal isolation in a wellbore, characterized in that it comprises the following steps:

placing a sealing element at a specific location along said wellbore, said sealing element comprising a sealing material which is a liquid or a gel allowing said sealing element to be able to deform both during and after placement;

activating said sealing material to transform to a solid or yield stress fluid, and thereafter maintaining the sealing element under compression after completion of the placement, wherein the activation is triggered by expansion of parts of a well tube crushing encapsulated components of the sealing material, by an external trigger, or by injection of an activator.

25. The method of claim 24, wherein there is a well tube within said well bore and the sealing element is placed on the outer surface of said well tube.

26. The method of claim 24, wherein the sealing element comprises an inflatable element, said inflatable element being inflated by a sealing material, in a liquid or gel state.

27. The method of claim 24, wherein there is a well tube within said well bore and at least part of the sealing material is placed after placement of the well tube.

28. The method of claim 27, wherein the sealing material is pumped from the surface through one or more ports in the well tube.

29. The method of claim 28, wherein the well tube comprises a valve, which is able to open or close said one or more ports.

30. The method of claim 24, wherein the sealing element is pumped as part of a fluid train from the surface through a well tubing into the annulus between the well tubing and the formation.

31. The method of claim 30, wherein the sealing element is placed using a delivery tube introduced into the well tube.

32. The method of claim 24, wherein an under-reaming is carried out and the sealing material is placed in the under-reamed section of the well.

33. The method of claim 24 wherein said sealing material is a liquid.

34. The method of claim 24 wherein said sealing material is a gel.

35. Use of the method according to claim 24 for plug and abandonment.

36. The method of claim 24, wherein said pathway is at least partially bounded by rock or cement.

37. The method of claim 24, wherein the sealing element is confined in a volume surrounded by materials of high Young's modulus, greater than 1000 Mpa.

38. A system for maintaining zonal isolation in a wellbore, characterized in that said system comprises, within a pathway at a specific location along said wellbore, a sealing element to block said pathway, said sealing element being able to deform both during and after placement and wherein the sealing element is maintained under compression after completion of the placement, thereby urging the deformable sealing element into contact with less deformable material bounding the pathway so as to maintain a seal against fluid migration along the pathway, wherein the sealing element comprises a sealing material, said sealing material being a yield stress fluid and the stress value of the sealing material is greater than 600 Pa.

39. The system of claim 38, wherein the sealing element is able to deform for at least 5 years after placement.

40. The system of claim 38, wherein the sealing element is confined in a volume surrounded by materials of high Young's modulus, greater than 1000 MPa.

41. The system of claim 38, wherein the sealing element is confined in a volume formed by well tubing, formation surrounding the wellbore and cement injected into the wellbore.

42. The system of claim 38, wherein the sealing material is sufficiently fluid prior to placement to be pumped or injected at a specific downhole location, and sets under pressure to a yield stress fluid.

43. Use of the system according to claim 38, for plug and abandonment.

44. A system for maintaining zonal isolation in a wellbore, characterized in that said system comprises, within a pathway at a specific location along said wellbore, a sealing element to block said pathway, said sealing element being able to deform both during and after placement and wherein the sealing element is maintained under compression after completion of the placement, thereby urging the deformable sealing element into contact with less deformable material bounding the pathway so as to maintain a seal against fluid migration along the pathway, wherein the sealing element is composite and comprises a first material which is a yield stress fluid and forms a continuous phase and a second material which is solid and forms a discontinuous phase intermingled with the continuous phase first material.

45. The system of claim 44, wherein the sealing element is confined in a volume surrounded by materials of high Young's modulus, greater than 1000 MPa.

46. The system of claim 44, wherein the sealing element is confined in a volume formed by well tubing, formation surrounding the wellbore and cement injected into the wellbore.

47. The system of claim 44, wherein the yield stress value of the sealing material is greater than 10 Pa.

48. The system of claim 44, wherein the sealing material is sufficiently fluid prior to placement to be pumped or injected at a specific downhole location, and sets under pressure to a yield stress fluid.

49. The system of claim 44, wherein the sealing element is able to deform for at least 5 years after placement.

50. Use of the system according to claim 44, for plug and abandonment.

* * * * *